US012292053B2

(12) United States Patent
Woolaway

(10) Patent No.: US 12,292,053 B2
(45) Date of Patent: May 6, 2025

(54) COMPUTERIZED SYSTEMS AND METHODS FOR AUTOMATIC CEILING FAN OPERATION

(71) Applicant: RESIDEO LLC, Golden Valley, MN (US)

(72) Inventor: James Woolaway, Carbondale, CO (US)

(73) Assignee: Resideo LLC, Golden Valley, MN (US)

( * ) Notice: Subject to any disclaimer, the term of this patent is extended or adjusted under 35 U.S.C. 154(b) by 0 days.

(21) Appl. No.: 18/443,474

(22) Filed: Feb. 16, 2024

(65) Prior Publication Data

US 2024/0280111 A1 Aug. 22, 2024

Related U.S. Application Data

(60) Provisional application No. 63/485,644, filed on Feb. 17, 2023.

(51) Int. Cl.
*F04D 25/08* (2006.01)
*F04D 27/00* (2006.01)

(52) U.S. Cl.
CPC ..... *F04D 25/088* (2013.01); *F04D 27/001* (2013.01)

(58) Field of Classification Search
CPC ..... F04D 25/088; F04D 27/001
See application file for complete search history.

(56) References Cited

U.S. PATENT DOCUMENTS 10,136,549 B2 * 11/2018 Steiner ..... G05D 23/1919
2010/0291858 A1 11/2010 Toy
2016/0018119 A1 * 1/2016 Desmet ..... F24F 7/007 236/1 C

FOREIGN PATENT DOCUMENTS

CN 213106337 U 12/2020

OTHER PUBLICATIONS

Extended European Search Report and Written Opinion in European Patent Application in EP 24 15 8096 mailed Jun. 25, 2024.

* cited by examiner

*Primary Examiner* — Eldon T Brockman
(74) *Attorney, Agent, or Firm* — Greenberg Traurig, LLP; Nicholas Martin; David J. Dykeman

(57) ABSTRACT

Disclosed are systems and methods that provide a novel framework for automatically and dynamically controlling operational modes of a ceiling fan based on real-time detected information related to a location (e.g., detected temperatures, heating or cooling demand, seasonal climate information and occupancy information). The framework can sense a temperature in/at a location (e.g., a temperature proximate to the ceiling fan), and leverage such temperature as input to determine which ceiling fan operation to execute. In some embodiments, occupancy data related to users' physical positioning respective to the ceiling fan can additionally be leveraged to discern the proper operation mode, and the mode's characteristics (e.g., speed and runtime). The framework can enable a reduction in resource expenditure (e.g., reduced energy usage and HVAC runtime, for example), as the ceiling fan can be utilized to maintain a location's temperature control without the need for heating or cooling operations of a HVAC system.

20 Claims, 15 Drawing Sheets

COMPUTERIZED SYSTEMS AND METHODS FOR AUTOMATIC CEILING FAN OPERATION

RELATED APPLICATION(S)

This application claims priority to and the benefit of U.S. Provisional Patent Application No. 63/485,644, filed Feb. 17, 2023, which is incorporated herein by reference in its entirety.

FIELD OF THE DISCLOSURE

The present disclosure is generally related to ceiling fan optimization, and more particularly, to a decision intelligence (DI)-based computerized framework that automatically and dynamically operates a ceiling fan(s) at a location.

BACKGROUND

Modern electronic control systems are used in a wide variety of applications contained within homes, businesses and structures (referred to as "locations"). Some examples of these systems include Thermostats, Heating, Ventilation and Air Conditioning (HVAC) controllers, and Smart Home controllers, which can sense and control a wide range of applications in the location. These systems often have features allowing them to control the comfort in the living environment through the control of an HVAC system.

Many structures and homes contain ceiling fans. These fans often contain fan blades that are attached to a central axis where an electric motor can rotate the fan blades to cause air to be displaced. The electric motors are often capable of operating bidirectionally allowing air to be pulled up to the ceiling or pushed down by the fan blades. Additionally, these may also be operated at different rotational speeds to control the amount of air flow displaced upwards or downwards.

SUMMARY OF THE DISCLOSURE

By convention, optimal operation of a ceiling fan can be based on a number of factors that correspond to the fan's operating environment. For example, in the summer when the temperature (in the house and/or outside the house, for example) is warm, and it is desired to cool the air in a house, it can be desirable to operate the ceiling fan so that air is displaced downwards. The beneficial effect of the fan's downward air flow is the increased evaporation of moisture on a person's skin. For example, this effect can be exothermic, and therefore cooling to the skin and the person. If there is no one in the room with the fan, there is little to no benefit to running the fan in these conditions.

In another example, in the winter when cooler/colder temperatures are present, and it is desired to heat the air in a structure, since warm air rises to the ceiling, it is advantageous to operate the ceiling fan to pull air upward causing an air circulation in the room to balance the room warmth. Running the fan to displace air downward in the winter would cause a more focused air flow across a person's skin and would have the undesirable effect of increasing skin moisture evaporation, thereby cooling off the person. Therefore, running the fan to circulate room air causes the warm ceiling air to distribute throughout the room. This, as a by-product, can prevent the heater from over running and unnecessarily building the temperature up at the ceiling.

In order to optimize fan operation in the winter, the fan should run at an adequate amount of fan speed or flow to cause warm air at the ceiling to circulate to balance the room air temperature. Operating at a rate above that required/threshold rate can cause increased energy use and the undesired effect of high air flow cooling to the skin.

To that end, according to some embodiments, the present disclosure provides systems and methods that can sense a temperature in a location, which can be specifically proximate to the ceiling fan (e.g., at the ceiling), and leverage such temperature as input to determine which ceiling fan operation to execute (e.g., downward or upward air displacement, and at particular rates). In some embodiments, as discussed herein, a location can refer to any type of definable and/or confined geographic and/or physical area for which a climate control system and/or ceiling fan can be applied, such as, not limited to, a home, office, building, garage, patio, structure and the like.

According to some embodiments, temperature sensing proximate to the ceiling fan (e.g., at the ceiling, as opposed to a general temperature reading in the location), can provide an ideal sensing location and link regarding the temperature data for the ceiling fan to base its operation on. As provided herein, this can enable a reduction in resource expenditure (e.g., reduced energy usage and HVAC runtime, for example), as the ceiling fan can be utilized to maintain a location's temperature control without the need for heating or cooling operations of a HVAC (or similar) system.

Indeed, while ceiling fans are generally well known, and the conventional operating practices for seasonal use are known to a lesser degree, modern ceiling fan controllers do not sense ceiling temperature, nor do they include functionality for, nor are they configured to control the ceiling fan in such a way as to provide the benefits described herein. That is, among other drawbacks, conventional ceiling fans and their operational functionalities and capabilities do not include the ability to optimize operation based on ceiling temperature, seasonal data and occupancy data of the location.

As such, as provided for herein, according to some embodiments, the disclosed systems and methods provide a novel framework that can control and/or integrate with a ceiling fan within a location to automatically and dynamically control and optimize the operational efficiency of the ceiling fan based on real-time detected ceiling temperatures, heating or cooling demand, seasonal climate information and occupancy information.

It should be understood by those of ordinary skill in the art that while the focus of the instant application is directed to electronically controlling a ceiling fan, it should not be construed as limiting, as any other type of electronic control system, such as, but not limited to, a stand-up/alone fan, HVAC system, humidifier, and the like, can be controlled and manipulated according to the disclosed systems and methods without departing from the scope of the instant disclosure.

According to some embodiments, a method is disclosed for automatically and dynamically controlling operational modes of a ceiling fan based on real-time detected information related to a location.

In accordance with some embodiments, the present disclosure provides a non-transitory computer-readable storage medium for carrying out the above-mentioned technical steps of the framework's functionality. The non-transitory computer-readable storage medium has tangibly stored thereon, or tangibly encoded thereon, computer readable instructions that when executed by a device cause at least one processor to perform a method for automatically and dynamically controlling operational modes of a ceiling fan based on real-time detected information related to a location.

In accordance with one or more embodiments, a system is provided that includes one or more processors and/or computing devices configured to provide functionality in accordance with such embodiments. In accordance with one or more embodiments, functionality is embodied in steps of a method performed by at least one computing device. In accordance with one or more embodiments, program code (or program logic) executed by a processor(s) of a computing device to implement functionality in accordance with one or more such embodiments is embodied in, by and/or on a non-transitory computer-readable medium.

DESCRIPTIONS OF THE DRAWINGS

The features, and advantages of the disclosure will be apparent from the following description of embodiments as illustrated in the accompanying drawings, in which reference characters refer to the same parts throughout the various views. The drawings are not necessarily to scale, emphasis instead being placed upon illustrating principles of the disclosure:

DETAILED DESCRIPTION

Figure 1:
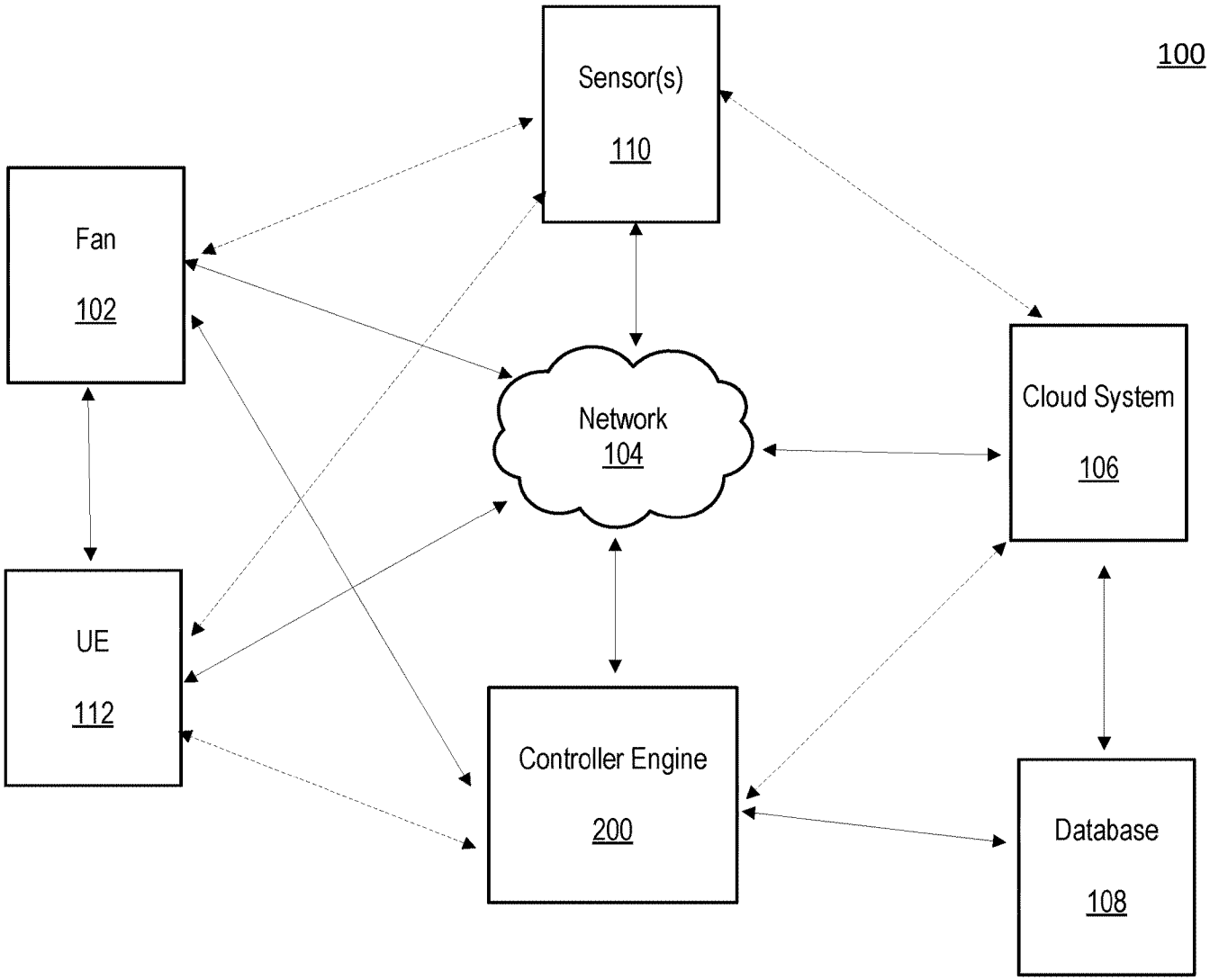
FIG. 1 is a block diagram of an example configuration within which the systems and methods disclosed herein could be implemented according to some embodiments of the present disclosure.

The present disclosure will now be described more fully hereinafter with reference to the accompanying drawings, which form a part hereof, and which show, by way of non-limiting illustration, certain example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The present disclosure is described below with reference to block diagrams and operational illustrations of methods and devices. It is understood that each block of the block diagrams or operational illustrations, and combinations of blocks in the block diagrams or operational illustrations, can be implemented by means of analog or digital hardware and computer program instructions. These computer program instructions can be provided to a processor of a general purpose computer to alter its function as detailed herein, a special purpose computer, ASIC, or other programmable data processing apparatus, such that the instructions, which execute via the processor of the computer or other programmable data processing apparatus, implement the functions/acts specified in the block diagrams or operational block or blocks. In some alternate implementations, the functions/acts noted in the blocks can occur out of the order noted in the operational illustrations. For example, two blocks shown in succession can in fact be executed substantially concurrently or the blocks can sometimes be executed in the reverse order, depending upon the functionality/acts involved.

For the purposes of this disclosure a non-transitory computer readable medium (or computer-readable storage medium/media) stores computer data, which data can include computer program code (or computer-executable instructions) that is executable by a computer, in machine readable form. By way of example, and not limitation, a computer readable medium may include computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, optical storage, cloud storage, magnetic storage devices, or any other physical or material medium which can be used to tangibly store the desired information or data or instructions and which can be accessed by a computer or processor.

For the purposes of this disclosure the term "server" should be understood to refer to a service point which provides processing, database, and communication facilities. By way of example, and not limitation, the term "server" can refer to a single, physical processor with associated communications and data storage and database facilities, or it can refer to a networked or clustered complex of processors and associated network and storage devices, as well as operating software and one or more database systems and application software that support the services provided by the server. Cloud servers are examples.

For the purposes of this disclosure a "network" should be understood to refer to a network that may couple devices so that communications may be exchanged, such as between a server and a client device or other types of devices, including between wireless devices coupled via a wireless network, for example. A network may also include mass storage, such as network attached storage (NAS), a storage area network (SAN), a content delivery network (CDN) or other forms of computer or machine-readable media, for example. A network may include the Internet, one or more local area networks (LANs), one or more wide area networks (WANs), wire-line type connections, wireless type connections, cellular or any combination thereof. Likewise, sub-networks, which may employ differing architectures or may be compliant or compatible with differing protocols, may interoperate within a larger network.

For purposes of this disclosure, a "wireless network" should be understood to couple client devices with a network. A wireless network may employ stand-alone ad-hoc networks, mesh networks, Wireless LAN (WLAN) networks, cellular networks, or the like. A wireless network may further employ a plurality of network access technologies, including Wi-Fi, Long Term Evolution (LTE), WLAN, Wireless Router mesh, or 2nd, 3rd, $4^{th}$ or $5^{th}$ generation (2G, 3G, 4G or 5G) cellular technology, mobile edge computing (MEC), Bluetooth, 802.11b/g/n, or the like. Network access technologies may enable wide area coverage for devices, such as client devices with varying degrees of mobility, for example.

In short, a wireless network may include virtually any type of wireless communication mechanism by which signals may be communicated between devices, such as a client device or a computing device, between or within a network, or the like.

A computing device may be capable of sending or receiving signals, such as via a wired or wireless network, or may be capable of processing or storing signals, such as in memory as physical memory states, and may, therefore, operate as a server. Thus, devices capable of operating as a server may include, as examples, dedicated rack-mounted servers, desktop computers, laptop computers, set top boxes, integrated devices combining various features, such as two or more features of the foregoing devices, or the like.

For purposes of this disclosure, a client (or user, entity, subscriber or customer) device may include a computing device capable of sending or receiving signals, such as via a wired or a wireless network. A client device may, for example, include a desktop computer or a portable device, such as a cellular telephone, a smart phone, a display pager, a radio frequency (RF) device, an infrared (IR) device a Near Field Communication (NFC) device, a Personal Digital Assistant (PDA), a handheld computer, a tablet computer, a phablet, a laptop computer, a set top box, a wearable computer, smart watch, an integrated or distributed device combining various features, such as features of the forgoing devices, or the like.

A client device may vary in terms of capabilities or features. Claimed subject matter is intended to cover a wide range of potential variations, such as a web-enabled client device or previously mentioned devices may include a high-resolution screen (HD or 4K for example), one or more physical or virtual keyboards, mass storage, one or more accelerometers, one or more gyroscopes, global positioning system (GPS) or other location-identifying type capability, or a display with a high degree of functionality, such as a touch-sensitive color 2D or 3D display, for example.

Certain embodiments and principles will be discussed in more detail with reference to the figures. According to some embodiments, the disclosed framework provides a novel framework for automatically (e.g., without user input) controlling ceiling fans in such a way that their operation is beneficial to the comfort level in a conditioned space. While ceiling fans are common place, their operation is not always beneficial in terms of providing increased comfort to the occupants or to managing (e.g., lowering) energy usage.

According to some embodiments, the use of ceiling fans in the summer and winter benefit from displacing the air downwards in the summer and upwards in the winter. Additionally, no benefit is had from operating in the summer unless someone is present in the conditioned room. As conventional ceiling fans do not know, nor are they configured to be programmed with information related to the details for optimal operation, a smart ceiling fan controller is described herein that optimizes comfort while minimizing energy use. As such, the disclosed systems and methods provide functionality and configuration enabling such optimizations and improved operational efficiency.

With reference to FIG. 1, a system is depicted for a location 100 which includes ceiling fan 102, user equipment (UE) 112 (e.g., a client device, as mentioned above and discussed below in relation to FIG. 15), sensors 110, network 104, cloud system 106, database 108 and controller engine 200. It should be understood that while system 100 is depicted as including such components, it should not be construed as limiting, as one of ordinary skill in the art would readily understand that varying numbers of ceiling fans, UEs, sensors, cloud systems, databases and networks can be utilized; however, for purposes of explanation, system 100 is discussed in relation to the example depiction in FIG. 1.

According to some embodiments, ceiling fan 102, as discussed above, can by any type of known or to be known ceiling fan (e.g., a fan with fan blades that are attached to a central axis where an electric motor can rotate the fan blades bidirectionally to cause air to be displaced). The fan 102 can be positioned on a ceiling within location 100 (e.g., in the middle of the ceiling, equidistant to each wall in the room (or area), for example). As discussed above and provided below in more detail, the ceiling fan 102 can include a number of blades that rotate clockwise and/or counter-clockwise at varying speeds and according to dynamically determined and/or preset operational modes.

According to some embodiments, UE 112 can be any type of device, such as, but not limited to, a mobile phone, tablet, laptop, sensor, Internet of Things (IoT) device, autonomous machine, and any other device equipped with a cellular or wireless or wired transceiver. In some embodiments, UE 112 can be a device associated with an individual (or set of individuals) for which climate control services are being provided. In some embodiments, UE 112 may correspond to a device of a climate service provider entity (e.g., a thermostat, whereby the device can be and/or can have corresponding sensors 110, as discussed herein).

In some embodiments, a peripheral device (not shown) can be connected to UE 112, and can be any type of peripheral device, such as, but not limited to, a wearable device (e.g., smart watch), printer, speaker, sensor, and the like. In some embodiments, a peripheral device can be any type of device that is connectable to UE 112 (and/or fan 102) via any type of known or to be known pairing mechanism, including, but not limited to, Bluetooth™, Bluetooth Low Energy (BLE), NFC, and the like.

According to some embodiments, a sensors 110 can correspond to sensors associated with a location of system 100. In some embodiments, the sensors 110 can be, but are not limited to, temperature sensors (e.g., thermocouples, resistance temperature detectors (RTDs), thermistors, semiconductor based integrated circuits (IC), thermometers, and the like, for example) cameras, glass break detectors, motion detectors, door and window contacts, heat and smoke detectors, carbon monoxide (CO) and/or carbon dioxide ($CO_2$) detectors, passive infrared (PIR) sensors, time-of-flight (ToF) sensors, and the like. Sensors 110 may also correspond to temperature sensors within and/or associated with fan 102. In some embodiments, the sensors 110 can involve an IoT environment and/or be associated with devices associated with the location of system 100, such as, for example, lights, smart locks, garage doors, smart appliances (e.g., thermostat, refrigerator, television, personal assistants (e.g., Alexa®, Nest®, for example)), smart phones, smart watches or other wearables, tablets, personal computers, and the like, and some combination thereof. For example, the sensors 110 can include the sensors on UE 112 (e.g., smart phone) and/or peripheral device (e.g., a paired smart watch).

According to some embodiments, as discussed in more detail below, sensors 110 can include a sensor located proximate a threshold distance and/or position to the ceiling fan 102. In some embodiments, the threshold distance can correspond to a proximate distance (e.g., dynamically determined and/or preset/predetermined) that enables a reading of the temperature around a predefined range of the fan 102 and not the temperature (average) of the location (or room, for example). As such, according to some embodiments, such sensor, referred to as a "ceiling sensor", can be positioned on the ceiling within a predetermined distance to the fan 102. As provided below in more detail, such ceiling sensor 110 can enable a determination of the current temperature at/around the ceiling fan so that engine 200 can utilize such information as factor for the fan operation determinations and optimization, as discussed herein. Additionally, such sensors 110, as discussed in more detail below, can provide indications of whether the location is currently being occupied by a living being (e.g., a person, pet, for example).

Accordingly, the ceiling sensor 110 can be any type of known or to be known sensor that can determine a current and/or range of temperatures at a location that are specific to a conditioned space within a location.

In some embodiments, network 104 can be any type of network, such as, but not limited to, a wireless network, cellular network, the Internet, and the like (as discussed above). Network 104 facilitates connectivity of the components of system 100, as illustrated in FIG. 1.

According to some embodiments, cloud system 106 may be any type of cloud operating platform and/or network based system upon which applications, operations, and/or other forms of network resources may be located. For example, system 106 may be a service provider and/or network provider from where services and/or applications may be accessed, sourced or executed from. For example, system 106 can represent the cloud-based architecture associated with a climate-control system (and/or security) provider, which has associated network resources hosted on the internet or private network (e.g., network 104), which enables (via engine 200) the security management discussed herein.

In some embodiments, cloud system 106 may include a server(s) and/or a database of information which is accessible over network 104. In some embodiments, a database 108 of cloud system 106 may store a dataset of data and metadata associated with local and/or network information related to a user(s) of UE 112/fan 102 and the UE 112/fan 102, sensors 110, and the services and applications provided by cloud system 106 and/or controller engine 200.

In some embodiments, for example, cloud system 106 can provide a private/proprietary management platform, whereby engine 200, discussed infra, corresponds to the novel functionality system 106 enables, hosts and provides to a network 104 and other devices/platforms operating thereon.

Figure 13:
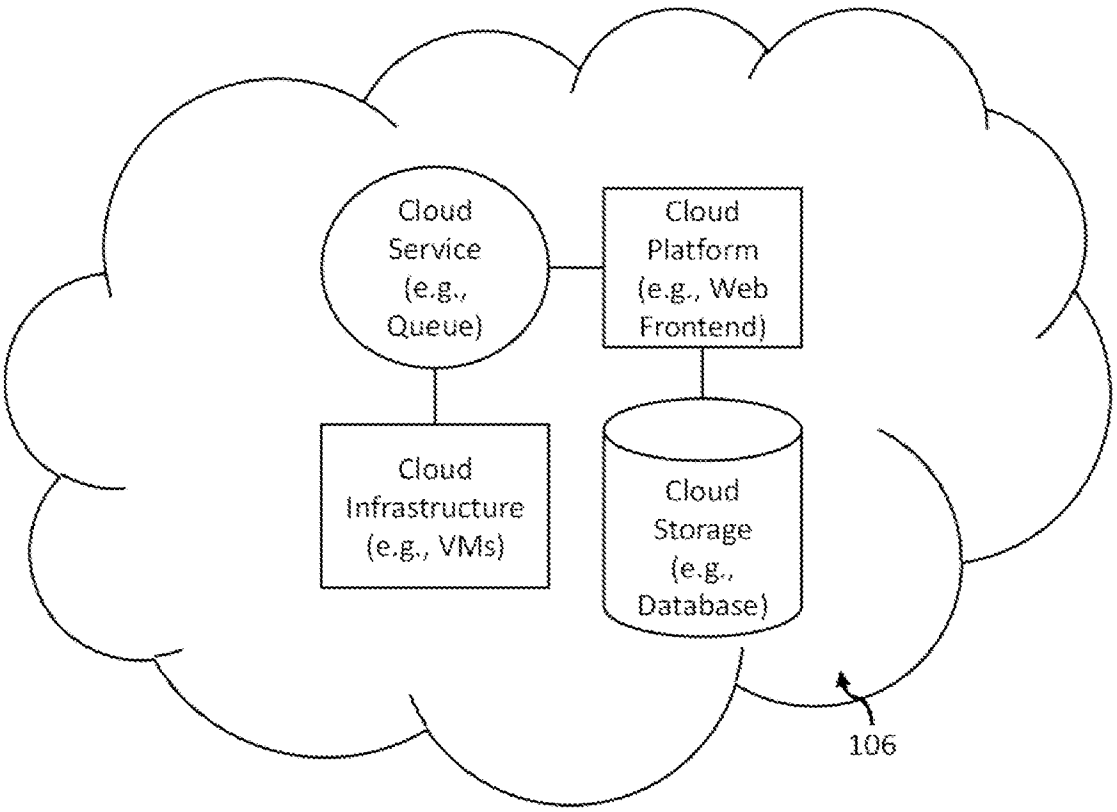
FIG. 13 depicts an exemplary implementation of an architecture according to some embodiments of the present disclosure.
Figure 14:
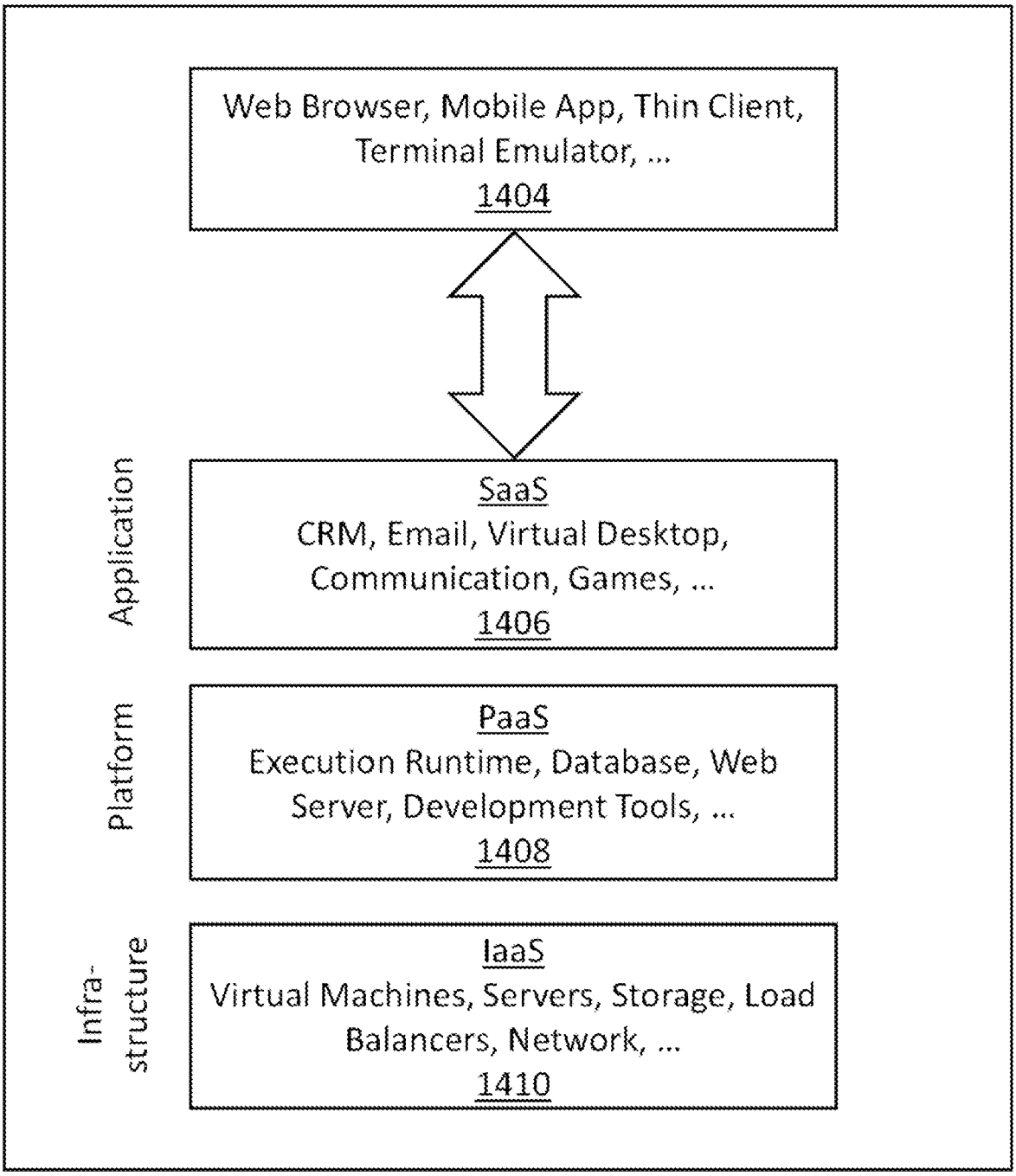
FIG. 14 depicts an exemplary implementation of an architecture according to some embodiments of the present disclosure.

Turning to FIG. 13 and FIG. 14, in some embodiments, the exemplary computer-based systems/platforms, the exemplary computer-based devices, and/or the exemplary computer-based components of the present disclosure may be specifically configured to operate in a cloud computing/architecture 106 such as, but not limiting to: infrastructure a service (IaaS) 1410, platform as a service (PaaS) 1408, and/or software as a service (SaaS) 1406 using a web browser, mobile app, thin client, terminal emulator or other endpoint 1404. FIG. 13 and FIG. 14 illustrate schematics of non-limiting implementations of the cloud computing/architecture(s) in which the exemplary computer-based systems for administrative customizations and control of network-hosted APIs of the present disclosure may be specifically configured to operate.

Turning back to FIG. 1, according to some embodiments, database 108 may correspond to a data storage for a platform (e.g., a network hosted platform, such as cloud system 106, as discussed supra), a plurality of platforms, and/or UE 112 and/or sensors 110. Database 108 may receive storage instructions/requests from, for example, engine 200 (and associated microservices), which may be in any type of known or to be known format, such as, for example, standard query language (SQL). According to some embodiments, database 108 may correspond to any type of known or to be known storage, for example, a memory or memory stack of a device, a distributed ledger of a distributed network (e.g., blockchain, for example), a look-up table (LUT), and/or any other type of secure data repository.

Controller engine 200, as discussed above and further below in more detail, can include components for the disclosed functionality. According to some embodiments, controller engine 200 may be a special purpose machine or processor, and can be hosted by a device on network 104, within cloud system 106, on UE 112, and/or fan 102 (and/or on sensors 110). In some embodiments, engine 200 may be hosted by a server and/or set of servers associated with cloud system 106.

According to some embodiments, as discussed in more detail below, controller engine 200 may be configured to implement and/or control a plurality of services and/or microservices, where each of the plurality of services/microservices are configured to execute a plurality of workflows associated with performing the disclosed security management. Non-limiting embodiments of such workflows are provided below.

According to some embodiments, as discussed above, controller engine 200 may function as an application provided by cloud system 106. In some embodiments, engine 200 may function as an application installed on a server(s), network location and/or other type of network resource associated with system 106. In some embodiments, engine 200 may function as application installed and/or executing on UE 112 and/or fan 102. In some embodiments, such application may be a web-based application accessed by UE 112 and/or devices associated with sensors 110 over network 104 from cloud system 106. In some embodiments, engine 200 may be configured and/or installed as an augmenting script, program or application (e.g., a plug-in or extension) to another application or program provided by cloud system 106 and/or executing on UE 112 and/or sensors 110.

Figure 2:
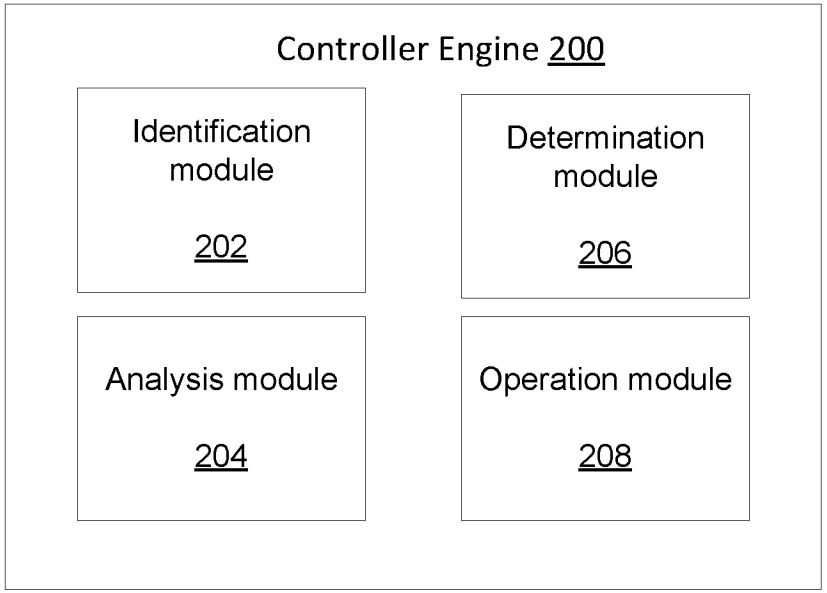
FIG. 2 is a block diagram illustrating components of an exemplary system according to some embodiments of the present disclosure.

As illustrated in FIG. 2, according to some embodiments, controller engine 200 includes identification module 202, analysis module 204, determination module 206 and operation module 208. It should be understood that the engine(s) and modules discussed herein are non-exhaustive, as additional or fewer engines and/or modules (or sub-modules) may be applicable to the embodiments of the systems and methods discussed. More detail of the operations, configurations and functionalities of engine 200 and each of its modules, and their role within embodiments of the present disclosure will be discussed below.

Figure 3:
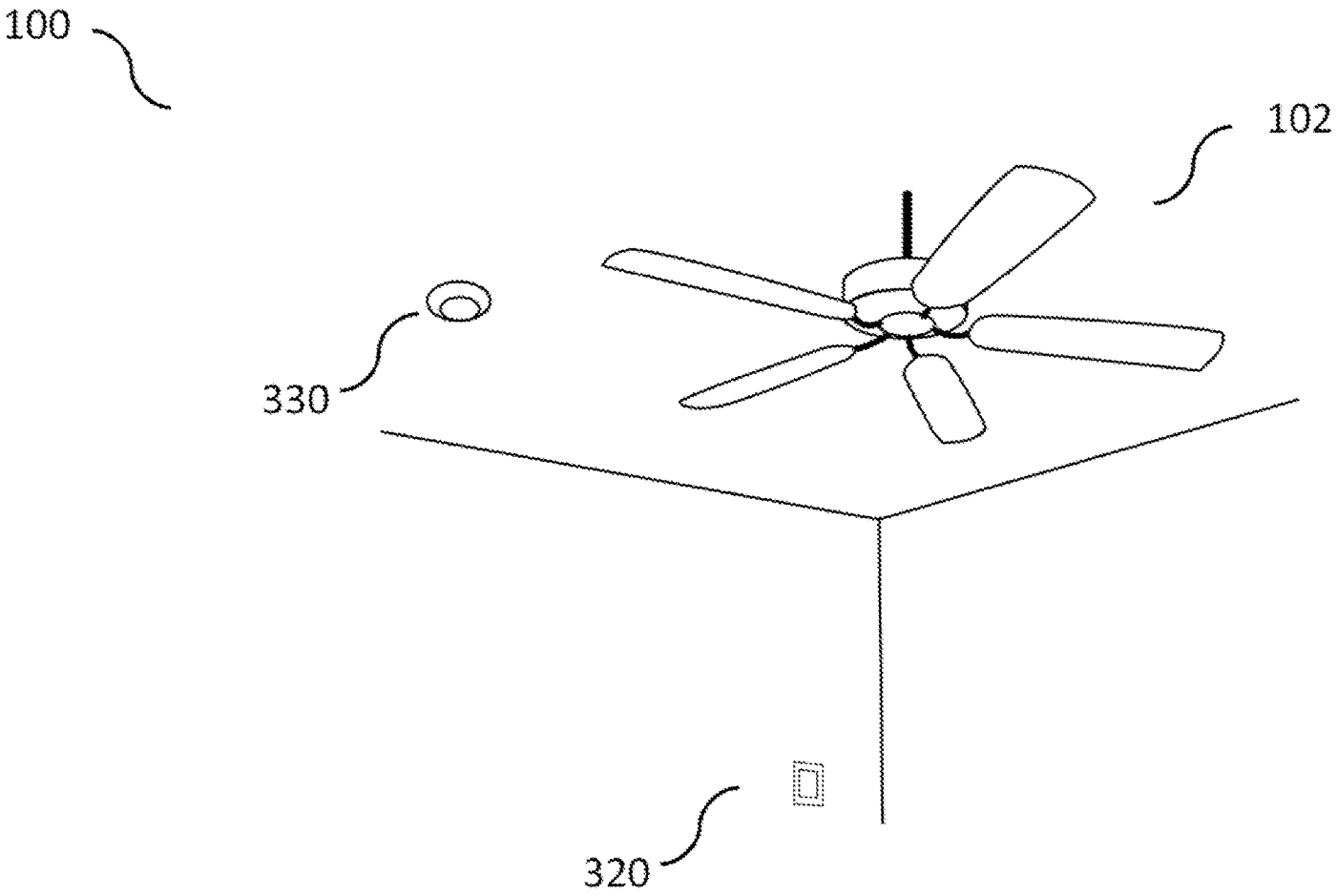
FIG. 3 depicts a non-limiting example operating environment according to some embodiments of the present disclosure.
Figure 4:
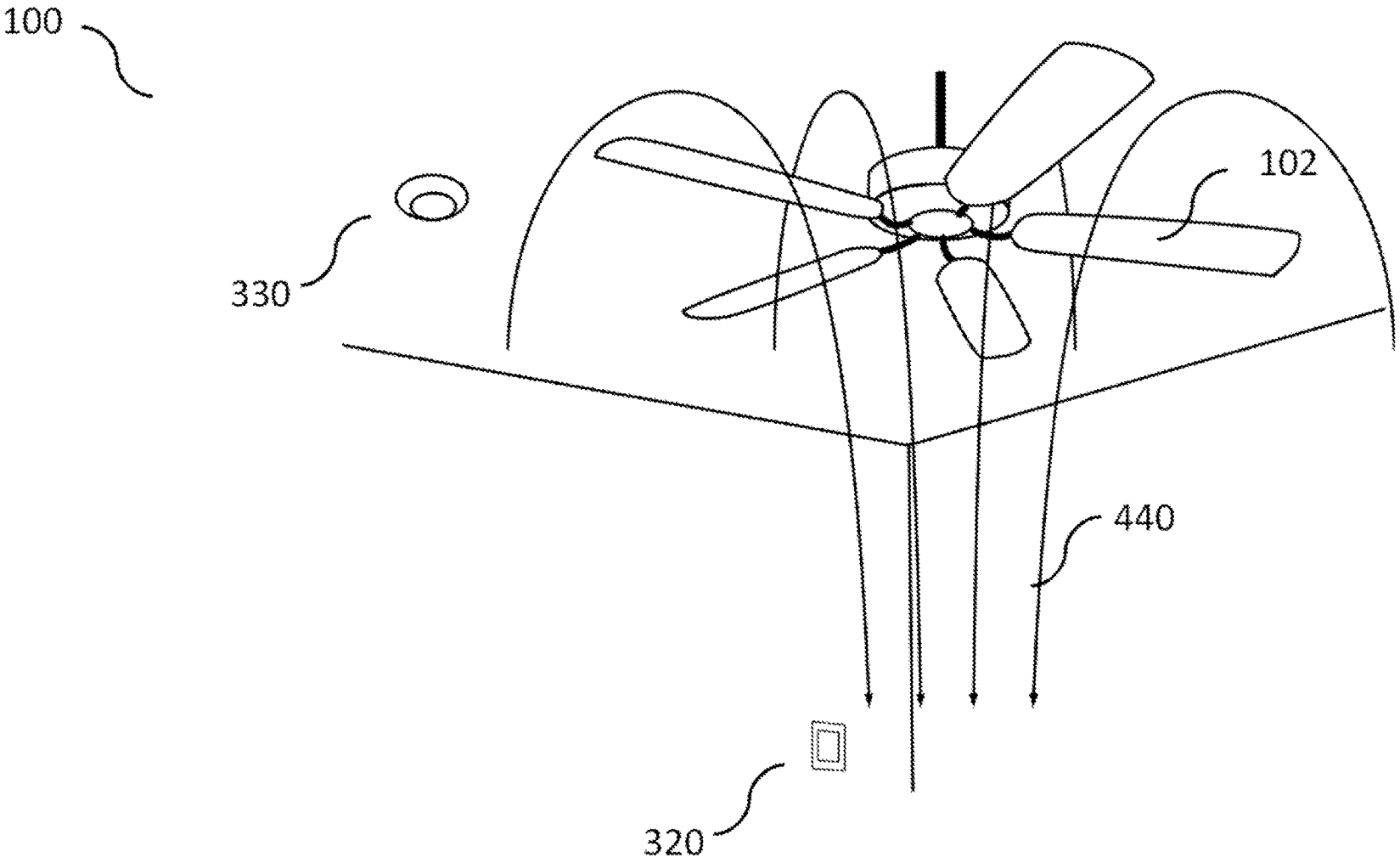
FIG. 4 depicts a non-limiting example operating environment according to some embodiments of the present disclosure.
Figure 5:
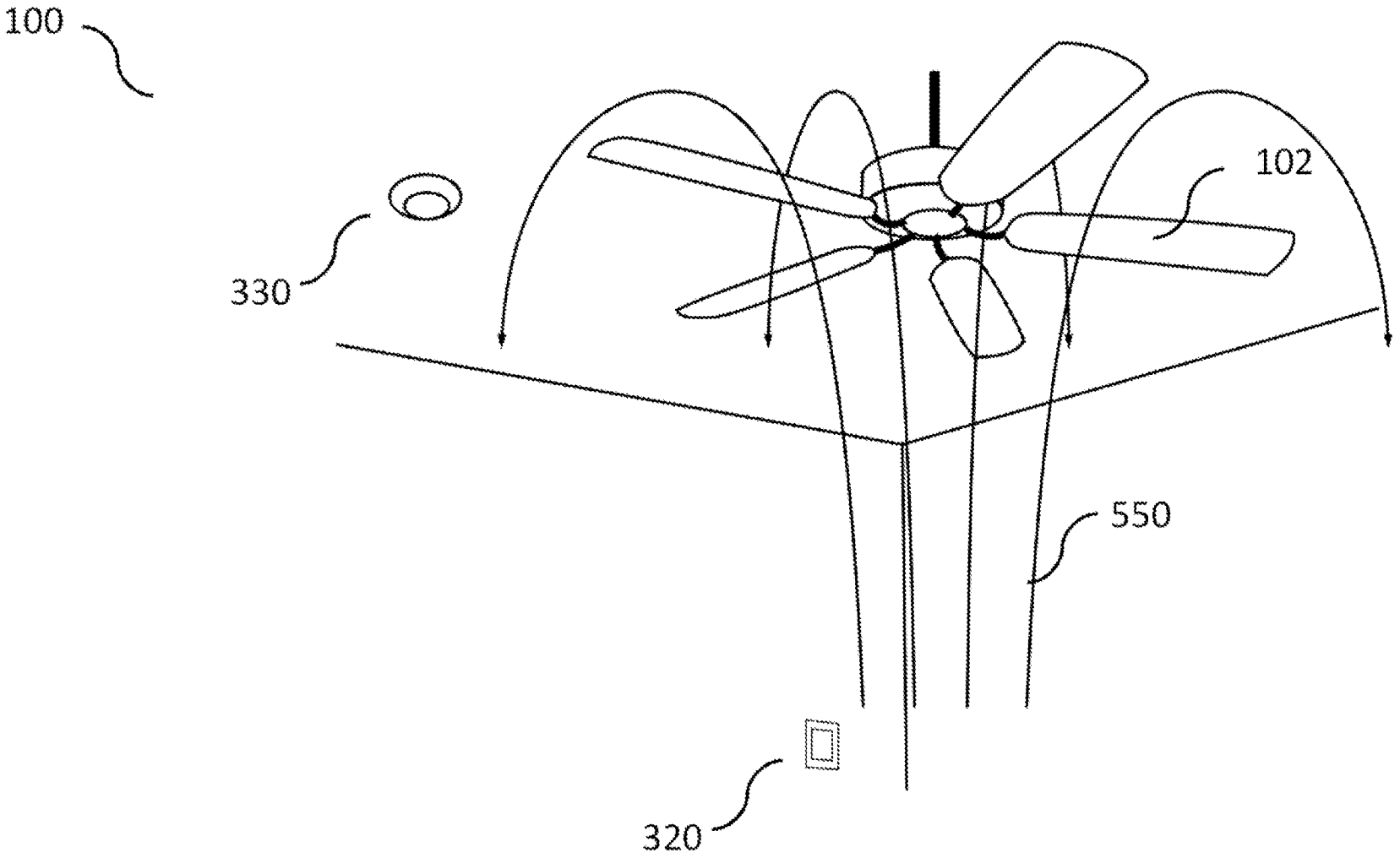
FIG. 5 depicts a non-limiting example operating environment according to some embodiments of the present disclosure.

Turning to FIGS. 3-5, depicted are non-limiting example operating environments provided for the disclosed ceiling fan 102 within location 102.

According to some embodiments, FIG. 3 depicts an upward prospective view of a location (e.g., room) 100 with ceiling fan 102. Ceiling fan 102 can be powered, as would be understood by one skilled in the art, by a controlled power source, such as, for example, a switched 120 VAC 60 Hz source. Ceiling fan 102 can contain a fan motor that has selectable rotation speeds and can operate in both rotational directions. According to some embodiments, ceiling fan 102 can be controlled by controller 320, which is depicted, in a non-limiting manners, to be positioned on the wall of the location 100 the left of the ceiling fan. The controller 320 can support manual and/or timed control of the speed and rotational direction of the ceiling fan 102. In some embodiments, controller 320 can be mount in an outlet box, for example.

According to some embodiments, for example, sensor 330 can be positioned on the ceiling, as discussed above in relation to sensors 110. Moreover, in some embodiments, sensor 330 can be positioned a predetermined distance to the ceiling fan 102 thereby enabling the collection of temperature data related to the ceiling and/or ceiling area associated with the fan 102 (e.g., temperature readings for an area encompassed by the circumference of the fan associated with the radial measurements of the fan blades).

FIG. 4 illustrates an example embodiment of ceiling fan 102 operating to displace air downward from the ceiling fan 102 within location 100. The downward airflow is identified via line items 440. Similarly, according to some embodiments, FIG. 5 depicts the ceiling fan operating in a reverse manner than the operation causing downward air 440, whereby the fan air is pulled upwards, as depicted by line items 550.

According to some embodiments, optimized ceiling fan operation generally comes under two principal consideration areas. The first is if the operation of the fan improves the comfort of a person in the room with the fan. The second is if the operation of the fan improves or degrades the energy efficiency of the heating or cooling for the area with the fan. For both of these considerations, there is a difference between winter and summer operation.

For optimal summer operation, where cooling in the structure is generally desired, the natural thermal profile in a room is where hotter air rises and builds up a thermal gradient from cooler to hotter from the floor to the ceiling. In this case it is preferred to maintain this thermal gradient as it naturally keeps the cooler air lower where people and pets are present in the room. However, if there is a person in the area of the ceiling fan, downward air fan operation will increase air flow across the persons skin and increase moisture evaporation and cooling of the skin. Therefore, there are several pieces of information that are important to the control of the ceiling fan for summer operation.

Figure 6:
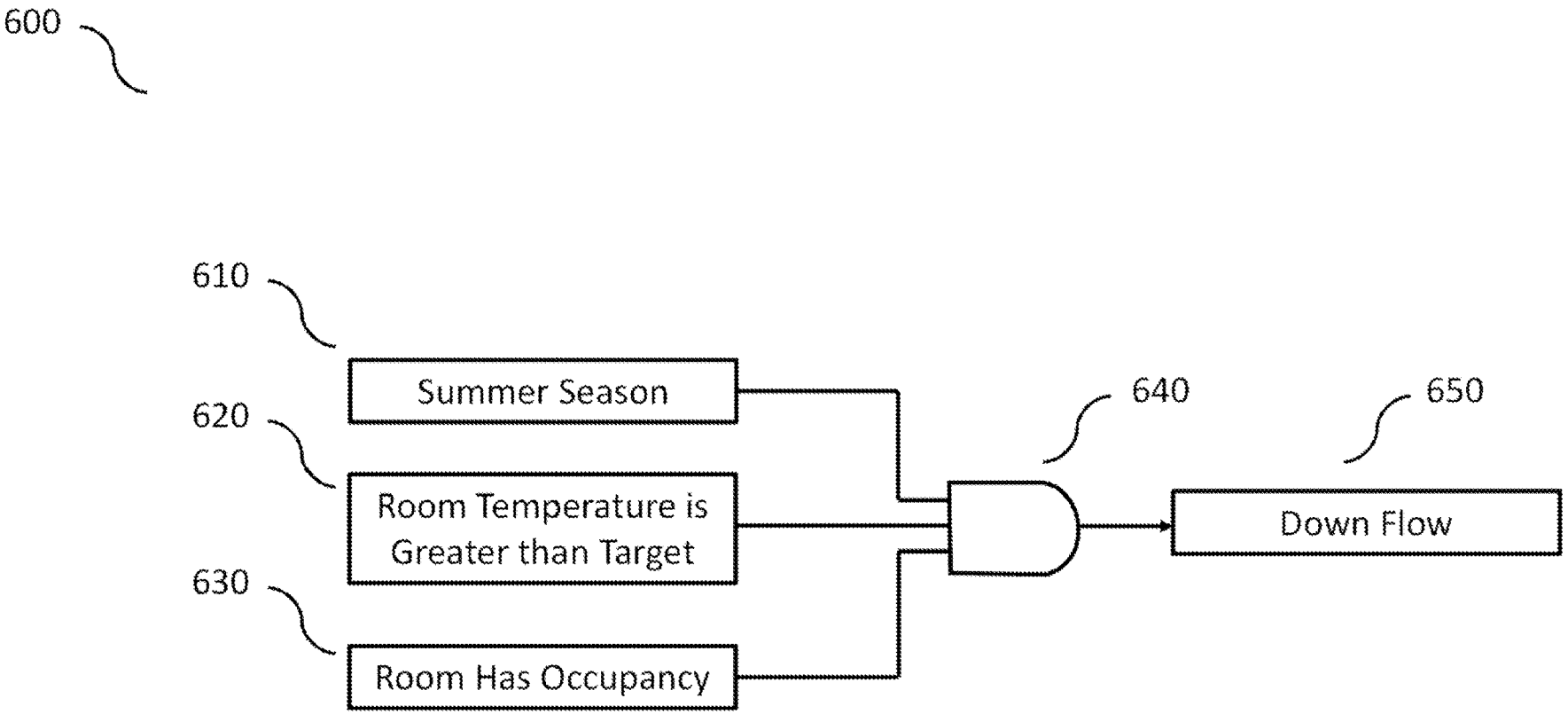
FIG. 6 illustrates an exemplary data flow according to some embodiments of the present disclosure.

As depicted in FIG. 6, illustrated is a "summer" algorithm 600 for controller engine 200 to operate. According to some embodiments, seasonal information 610 (e.g., which can be determined based on the date, regional data, and location, for example) can be used to indicate the season. If the season is summer, then the other conditions can be tested to determine if and how the fan should run. The next condition tested, room temperature 620, checks to see if the room thermostat is calling for cooling. If the thermostat is calling for cooling, for example, it has been set to a temperature lower than the current room temperature, and it is indicating that it is thermally beneficial to provide conditional fan operation. In some embodiments, room temperature 620 may be evaluated from any of the temperature sensors present in the room (e.g., sensors 110 from FIG. 1, discussed supra).

By way of example, in some embodiments, it is summer 610, and calling for cooling 620, and the condition for occupancy 630 tests true (e.g., at least one person or pet (or living being, for example, is determined/detected as being currently within the confines of the room, for example), then the fan can operate. In some embodiments, occupancy data can be determined via sensors 110, as mentioned above, and in more detail below.

According to some embodiments, as discussed in more detail below, a conditional criteria for the ceiling fan's operation for summer use, as depicted in FIG. 6, can be satisfied when the following tests are true: it is Summer 610, AND there is a call for cooling 620, AND there is room occupancy 630. A logical AND of these states 640 then produces a logical state for fan operation in the downward flow direction 650.

According to some embodiments, for optimal winter operation, where heating in the location 100 is generally desired, the natural thermal profile in a room is where hotter air rises and builds up a thermal gradient from cooler to hotter from the floor to the ceiling respectively. According to some embodiments, it may be preferred to circulate the warm ceiling air to minimize the thermal gradient and to warm the lower extent of the room where people and pets are present. There are therefore several pieces of information that are important to the control of the ceiling fan for winter operation.

Figure 7:
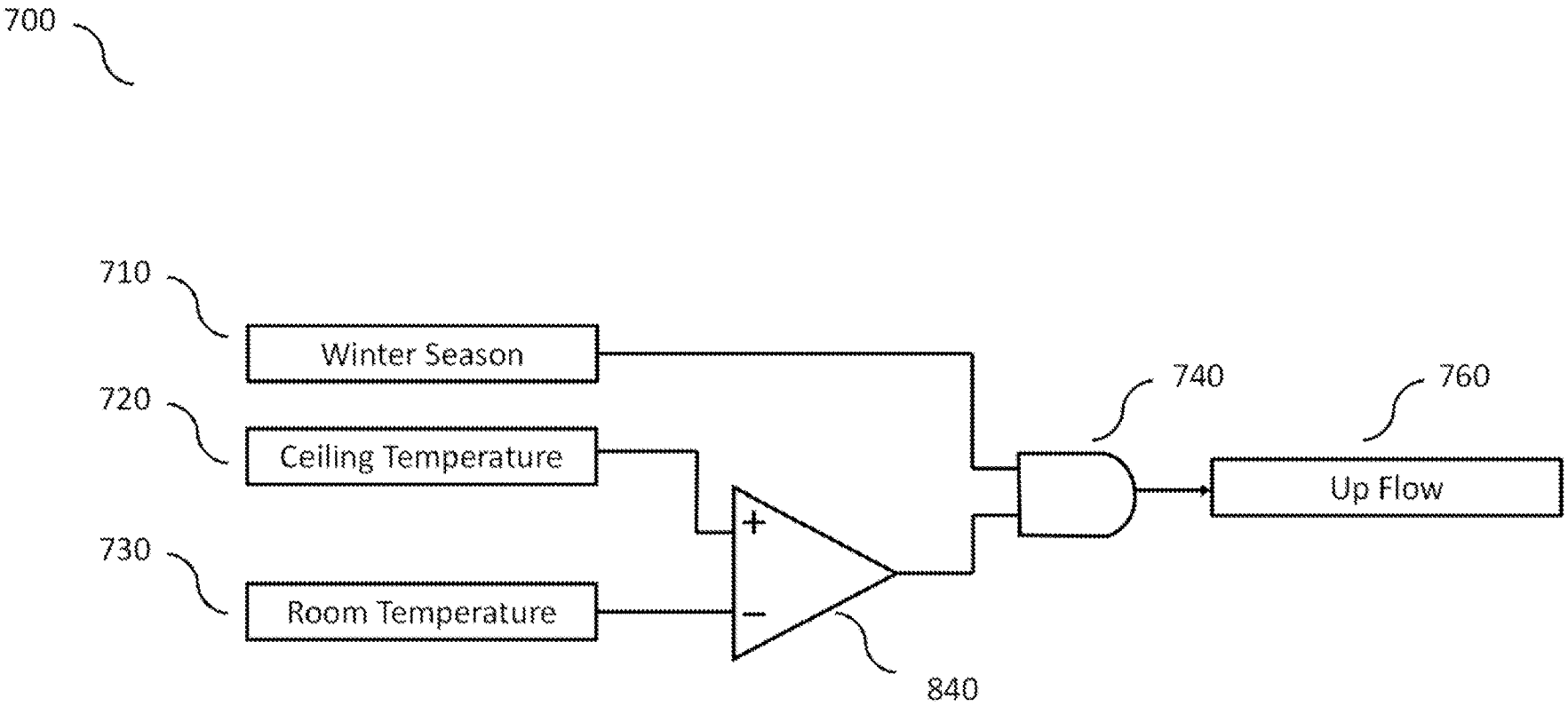
FIG. 7 illustrates an exemplary data flow according to some embodiments of the present disclosure.

Thus, as depicted in FIG. 7. Illustrated is a "winter" algorithm 700 for operation by controller engine 200. According to some embodiments, seasonal information 710 (e.g., which can be determined/derived based on the date, regional data, and location, for example), can be used to indicate the season. If the season is winter, then the other conditions can be tested to determine if and how the fan should run.

In some embodiments, next conditions tested, which includes the ceiling fan temperature 720 and the room temperature 730, involve determining whether the room ceiling temperature 720 is above the room temperature 730 (where, in some embodiments, the room temperature 730 can be provided/measured via the thermostat within the location 100). Comparator 840, as depicted in FIG. 7, is configured to perform a comparison of the temperature values from items 720 and 730.

It should be understood that while a simple comparator 840 is illustrated in FIG. 7, some embodiments of the functionality for logical block 840 can involve the integration of the difference between the ceiling temperature 720 and room temperature 730 (via the sensors collecting such temperature data, respectively), and to proportionally control speeds of ceiling fan 102 in response to this integrated difference. In some embodiments, algorithm 700 can involve filtering the integrated value, so that the ceiling fan control is slow and does not react to short term temperature variations. Logical block 740 (e.g., logical AND) outputs from season 710 and difference integrator 840 to pass information related to the control state and magnitude to upward fan control state 760.

Figure 8:
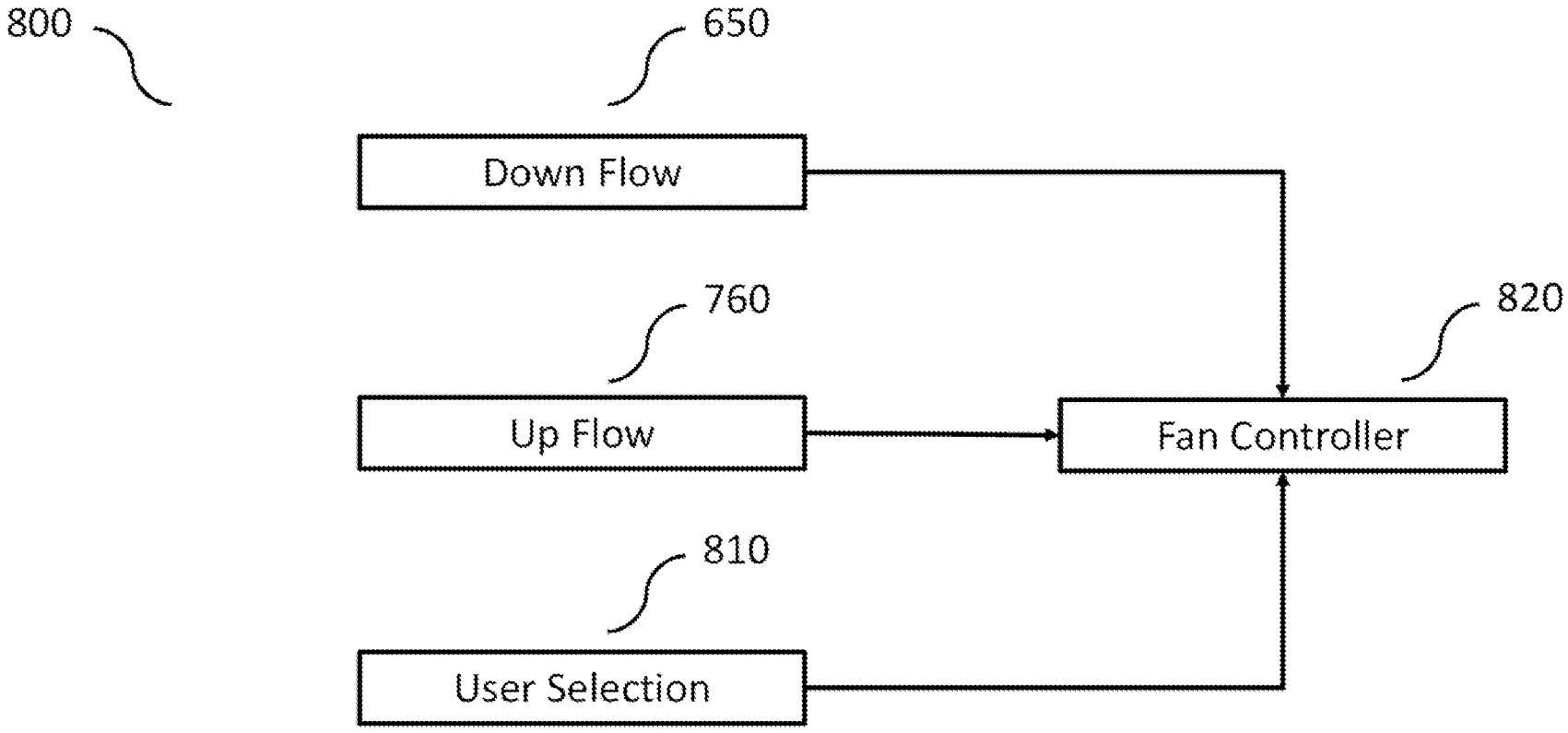
FIG. 8 illustrates an exemplary data flow according to some embodiments of the present disclosure.

In FIG. 8, according to some embodiments, downward and upward fan control states 650 and 760 are shown to interact with user control state 810. According to some embodiments, ceiling fan controller block 820 (which corresponds to controller engine 200, as discussed herein), can process information from the downward fan control state 650, upward fan control state 760, and the user control state selection 810.

Figure 9:
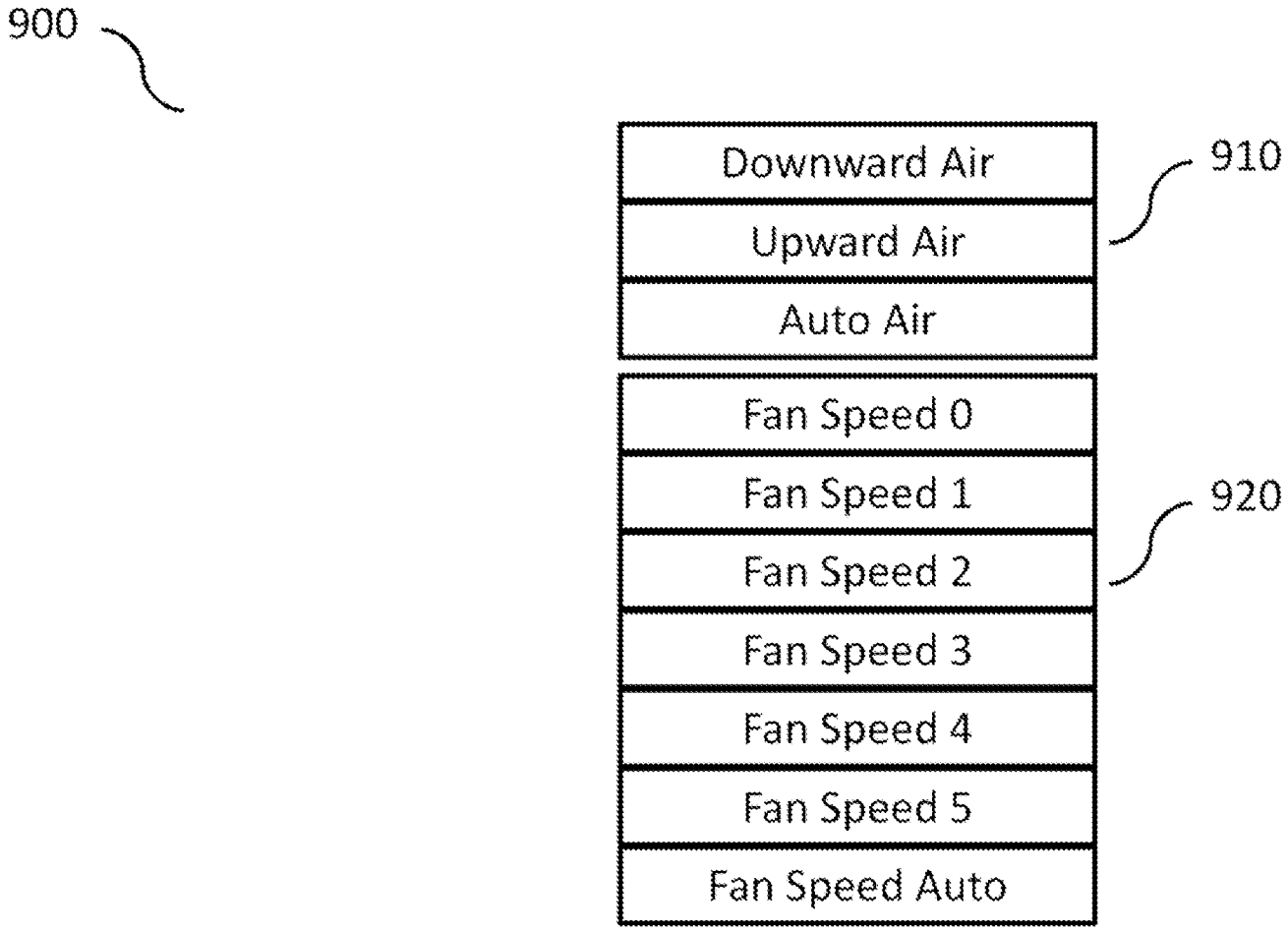
FIG. 9 depicts exemplary control stats according to some embodiments of the present disclosure.

As depicted in FIG. 9, an example of the control states 900 are provided. The control states 900 can define fan states 910, such as, but not limited to, upward air, downward air and auto air direction. The control states 900 can also define fan speeds 920. Fan speeds can be a range of speeds that increase incrementally, for example, can be from 0 to 5. In some embodiments, the fan speeds can be set to override the summer algorithm 600 and/or winter algorithm 700, and/or to utilize them. In some embodiments, settings for the air auto and speed auto can default to the algorithmic control (e.g., 600 and/or 700) for the ceiling fan. In some embodiments, settings upward air, downward air, and speeds 0-5 may be configured to override the controls provided by algorithms 600 and/or 700.

Figure 10:
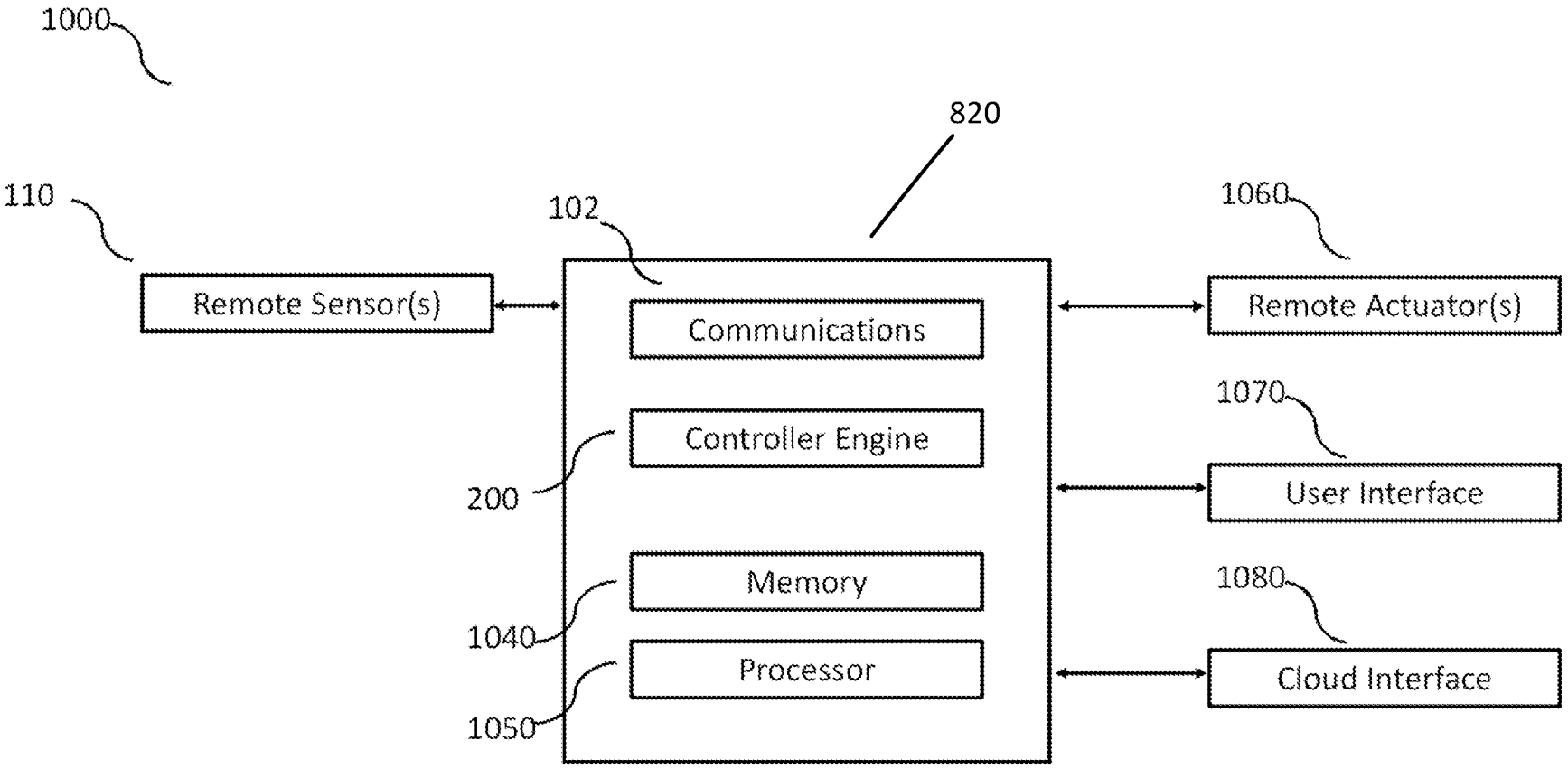
FIG. 10 depicts an exemplary system according to some embodiments of the present disclosure.

In FIG. 10, depicted are electronic configurations of components 1000 for implementation of algorithms 600 and/or 700, as discussed herein. The electric components 1000 can be utilized and/or included within the components of ceiling fan 102. For example, according to some embodiments, remote sensors 110 can provide sensor data to the controller 820, which can include, but is not limited to, ceiling temperature, room temperature, occupancy, and heating or cooling demand data, as mentioned above. In some embodiments, processor 1050, utilizing memory 1040, can process algorithms 600/700 via engine 200 for the appropriate operational state, which can actuate the fan 102 for rotational direction and speed through remote actuators interface 1060. According to some embodiments, such actuation is not limited to controlling the ceiling fan 102, as such actuation can control other actuators, such as, for example opening or closing a window and/or doors, opening and/or closing vents, and the like, as would be understood by a person of ordinary skill in the art. Optional user interface 1070 and cloud interface 1080 are shown in FIG. 10, where interface 1070 can depict control states that are being operated, and interface 1080 can enable integration and/or control via cloud system 106, as discussed above.

Figure 11:
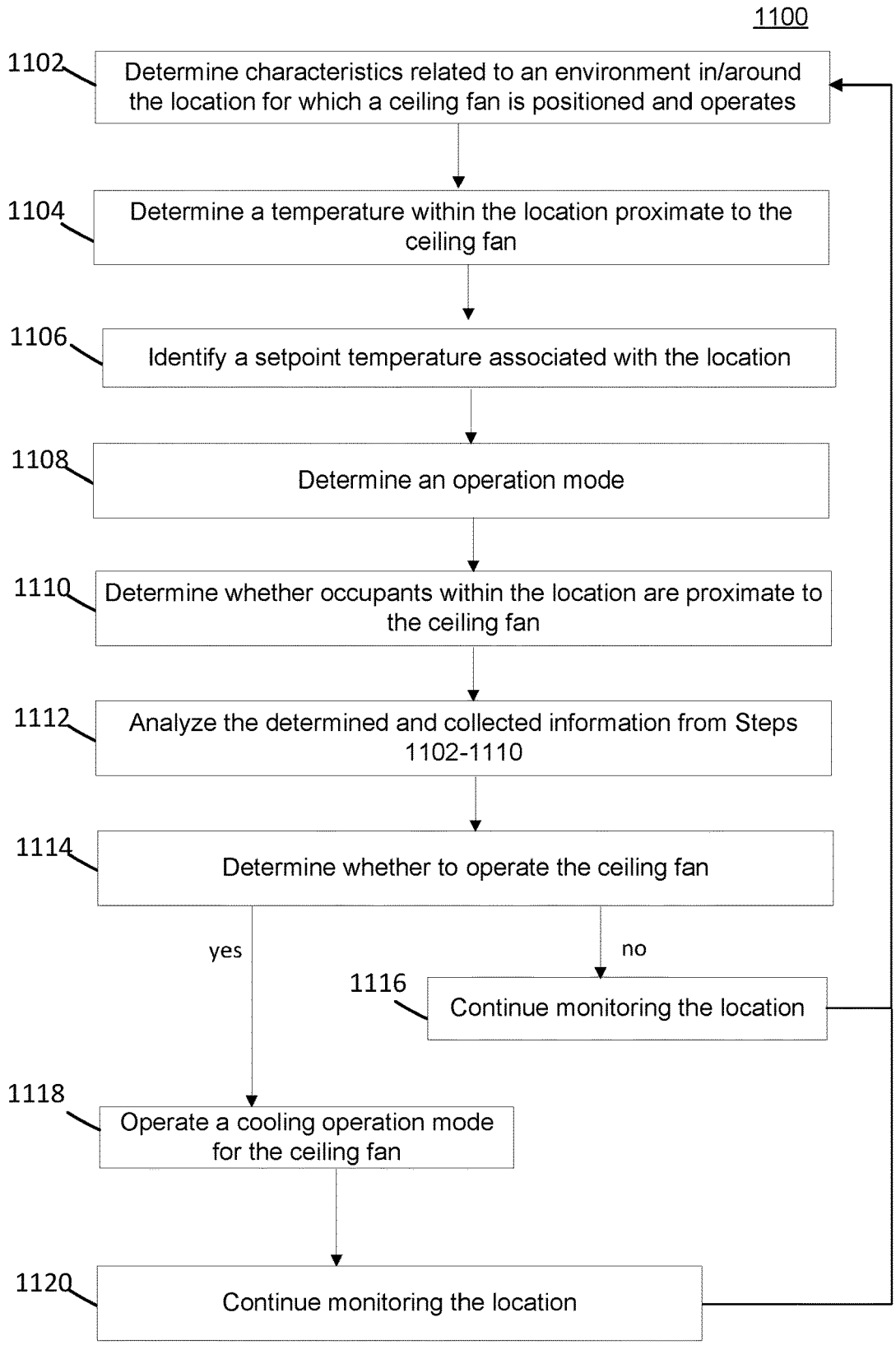
FIG. 11 illustrates an exemplary workflow according to some embodiments of the present disclosure.

Turning to FIG. 11, Process 1100 provides non-limiting example embodiments for the disclosed framework to operate the summer algorithm 600.

According to some embodiments, Steps 1102-1106 of Process 1100 can be performed by identification module 202 of controller engine 200; Steps 1108-1110 and 1114 can be performed by determination module 206; Step 1112 can be performed by analysis module 204; and Steps 1116-1120 can be performed by operation module 208.

According to some embodiments, Process 1100 begins with Step 1102 where engine 200 can determine (or identify) characteristics related to an environment in and/or around the location for which a ceiling fan is positioned and operates. According to some embodiments, the characteristics can be related to, but not limited to, the geographic location (e.g., GPS coordinates, longitude and latitude lines, zip code, address, and the like), elevation of the location, time, date, time zone, temperature within the room, temperature at/around the ceiling fan, number of people (or living beings within the location, for example, humans or pets), and/or other weather and/or climate conditions (e.g., humidity, precipitation, and the like), and the like, or some combination thereof. In some embodiments, such information can be collected and/or determined via sensors 100, as discussed supra.

In Step 1104, engine 200 can determine the temperature within the location proximate to the ceiling fan. As mentioned above, this temperature can correspond to the sub-climate at the ceiling of the location—for example, what are the temperature conditions around the ceiling fan. For example, sensor 330 can determine what the current temperature is at the ceiling fan 102, as illustrated in FIG. 3.

In Step 1106, engine 200 can determine a temperature setpoint associated with location. The setpoint temperature can correspond to the temperature in the location (e.g., within the room), as set per the thermostat associated with the climate system fitted to the location, as discussed above.

In Step 1108, engine 200 can determine an operation mode for the ceiling fan. According to some embodiments, as discussed above, such determination can be based on the collected characteristics of the location (as determined in Step 1102) and the temperatures collected in Steps 1104-1106. For example, based on the geographic location, and the date, it can be determined that the season is "summer" (e.g., located in Chicago, IL during July). Further, engine 200 can determine that the temperature at the ceiling fan (from Step 1104) is greater than the temperature setpoint (from Step 1106). Therefore, the operation mode of the ceiling fan can be determined based therefrom—for example, the operation mode can be determined to operate via the "summer" algorithm 600, discussed supra. In some embodiments, such determination may indicate that a "winter" algorithm is required, thereby the operational steps of Process 1200 of FIG. 12, discussed infra, can be performed.

Accordingly, Step 1108 can determine that the operation mode of the ceiling fan is to operate in a manner to displace air downwards. In some embodiments, the rate of spin of the ceiling fan can be proportional to the temperature differential between the ceiling fan temperature (from Step 1104) and the setpoint temperature (from Step 1106). In some embodiments, the rate of spin and/or duration of operation may correspond to a temperature outside and/or inside (e.g., if at or above a threshold amount. For example, if the temperature setpoint is 72 degrees Fahrenheit and the ceiling fan temperature is 99 degrees Fahrenheit, then the rate of spin may be at a "5" or top speed, and may run for longer should the ceiling fan temperature be closer in range to the setpoint.

In Step 1110, engine 200 can determine whether there are currently any occupants in the location. For example, in a house, whether there are any humans and/or pets within the room for which the ceiling fan is located. For example, if the fan is located in the living room, and the occupants of the house are located in the kitchen, then the determination in Step 1110 would be that there are no occupants in the room.

In some embodiments, the determination of Step 1110 can be performed via analysis of the collected sensor data from sensors 110, as discussed above. For example, a ToF sensor or motion detection sensor can provide information indicating whether occupants are in the room/location associated with the ceiling fan.

In Step 1112, engine 200 can analyze the information collected from Steps 1102-1110 (e.g., the temperatures associated with the setpoint, ceiling fan, and the occupancy indicators (e.g., true vs. false), and, in Step 1114, determine whether to operate the ceiling fan.

According to some embodiments, engine 200 can implement any type of known or to be known computational analysis technique, algorithm, mechanism or technology to perform the analysis and determination in Steps 1112-1114.

In some embodiments, engine 200 may include a specific trained artificial intelligence/machine learning model (AI/ML), a particular machine learning model architecture, a particular machine learning model type (e.g., convolutional neural network (CNN), recurrent neural network (RNN), autoencoder, support vector machine (SVM), and the like), or any other suitable definition of a machine learning model or any suitable combination thereof.

In some embodiments, engine 200 may be configured to utilize one or more AI/ML techniques chosen from, but not limited to, computer vision, feature vector analysis, decision trees, boosting, support-vector machines, neural networks, nearest neighbor algorithms, Naive Bayes, bagging, random forests, logistic regression, and the like. By way of a non-limiting example, engine 200 can implement an XGBoost algorithm for regression and/or classification to analyze the sensor data, as discussed herein.

According to some embodiments and, optionally, in combination of any embodiment described above or below, a neural network technique may be one of, without limitation, feedforward neural network, radial basis function network, recurrent neural network, convolutional network (e.g., U-net) or other suitable network. In some embodiments and, optionally, in combination of any embodiment described above or below, an implementation of Neural Network may be executed as follows:

a. define Neural Network architecture/model,
b. transfer the input data to the neural network model,
c. train the model incrementally,
d. determine the accuracy for a specific number of timesteps,
e. apply the trained model to process the newly-received input data,
f. optionally and in parallel, continue to train the trained model with a predetermined periodicity.

In some embodiments and, optionally, in combination of any embodiment described above or below, the trained neural network model may specify a neural network by at least a neural network topology, a series of activation functions, and connection weights. For example, the topology of a neural network may include a configuration of nodes of the neural network and connections between such nodes. In some embodiments and, optionally, in combination of any embodiment described above or below, the trained neural network model may also be specified to include other parameters, including but not limited to, bias values/functions and/or aggregation functions. For example, an activation function of a node may be a step function, sine function, continuous or piecewise linear function, sigmoid function, hyperbolic tangent function, or other type of mathematical function that represents a threshold at which the node is activated. In some embodiments and, optionally, in combination of any embodiment described above or below, the aggregation function may be a mathematical function that combines (e.g., sum, product, and the like) input signals to the node. In some embodiments and, optionally, in combination of any embodiment described above or below, an output of the aggregation function may be used as input to the activation function. In some embodiments and, optionally, in combination of any embodiment described above or below, the bias may be a constant value or function that may be used by the aggregation function and/or the activation function to make the node more or less likely to be activated.

As such, in Step 1114, engine 200 can determine whether to operate the ceiling fan for the "summer" algorithm 600, as discussed above. According to some embodiments, when engine 200 determines that there are no occupants in the location associated with the ceiling fan (and/or that the temperature of the ceiling fan is within range of the temperate setpoint), then engine 200 can proceed from Step 1114 to Step 1116, where the ceiling fan's operation is bypassed (e.g., it is not operated, and engine 200 recursively reverts back to Step 1102 for continued monitoring of the location.

According to some embodiments, when engine 200 determines that there is at least one occupant in the location associated with the ceiling fan (and/or that the temperature of the ceiling fan is outside a range of the temperate setpoint), then engine 200 can proceed from Step 1114 to Step 1118, where the ceiling fan is set to a cooling operation mode, which is then executed, as in Step 1118. According to some embodiments, during the cooling mode operation, and/or upon its conclusion, engine 200 can proceed to Step 1120, where engine 200 recursively reverts back to Step 1102 for continued monitoring of the location.

Figure 12:
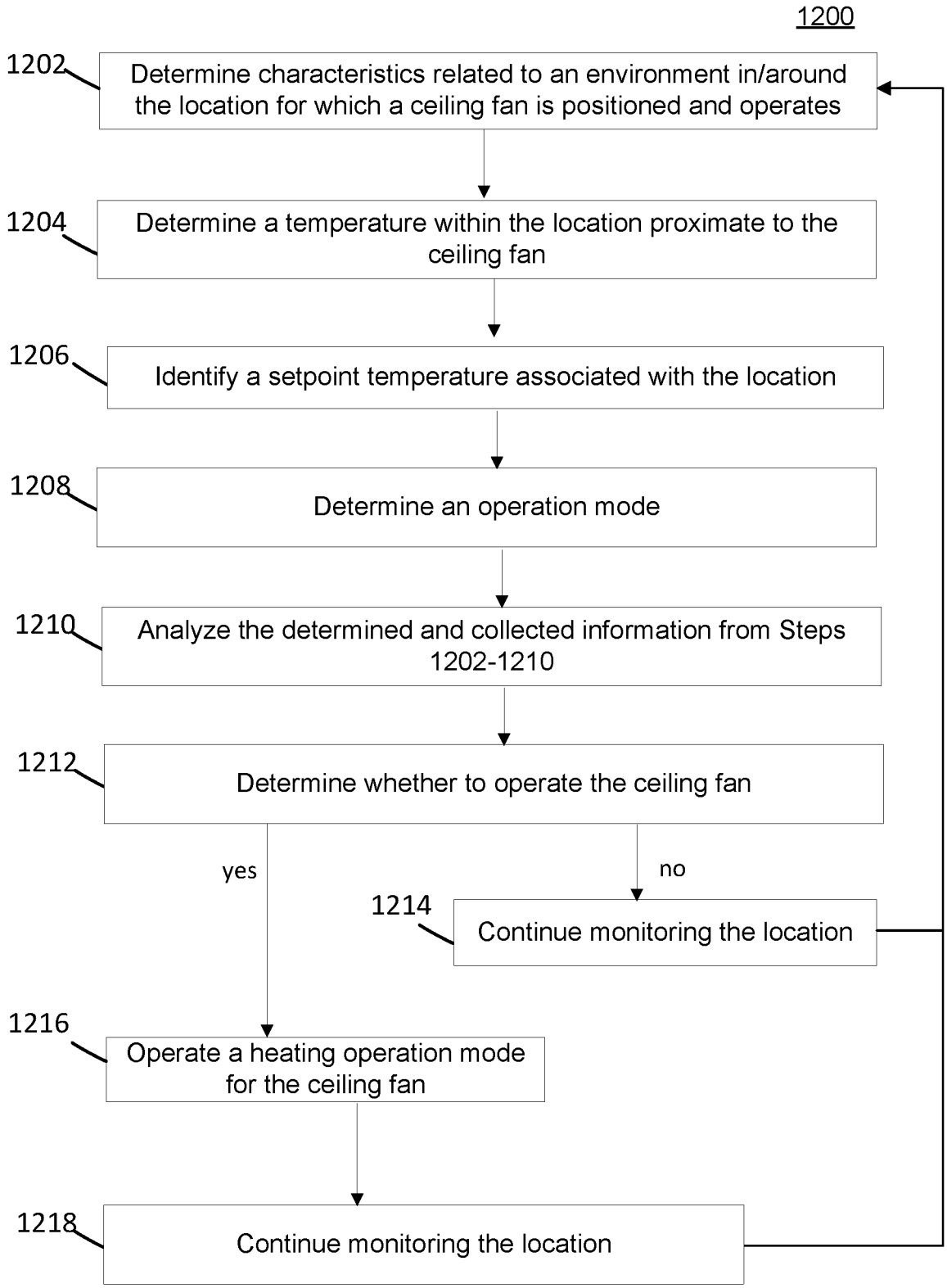
FIG. 12 illustrates an exemplary workflow according to some embodiments of the present disclosure.

Turning to FIG. 12, Process 1200 provides non-limiting example embodiments for the disclosed framework to operate the winter algorithm 700.

According to some embodiments, Steps 1202-1206 of Process 1200 can be performed by identification module 202 of controller engine 200; Steps 1208 and 1212 can be performed by determination module 206; Step 1210 can be performed by analysis module 204; and Steps 1214-1218 can be performed by operation module 208.

According to some embodiments, Process 1200 begins with Step 1202-1206, which can be performed in a similar manner as discussed above at least in relation to Steps 1102-1106 of Process 11 of FIG. 11.

In Step 1208, engine 200 can determine an operation mode for the ceiling fan. According to some embodiments, as discussed above, such determination can be based on the collected characteristics of the location (as determined in Step 1202) and the temperatures collected in Steps 1204-1206. For example, based on the geographic location, and the date, it can be determined that the season is "winter" (e.g., located in Chicago, IL during December). Further, engine 200 can determine that the temperature at the ceiling fan (from Step 1204) is less than the temperature setpoint (from Step 1206). Therefore, the operation mode of the ceiling fan can be determined based therefrom—for example, the operation mode can be determined to operate via the "winter" algorithm 700, discussed supra.

Accordingly, Step 1208 can determine that the operation mode of the ceiling fan is to operate in a manner to pull air upward causing an air circulation in the room to balance the room warmth. In some embodiments, the rate of spin of the ceiling fan, as well as the duration of the fan's operation, can be proportional to or based on the temperature differential between the ceiling fan temperature (from Step 1204) and the setpoint temperature (from Step 1206).

In some embodiments, Step 1208 can further involve the determination of whether occupants are within the room/location, which can be performed in as similar manner as discussed above at least in relation to Step 1110.

In Step 1210, engine 200 can analyze the information collected from Steps 1202-1210 (e.g., the temperatures associated with the setpoint, ceiling fan, and the occupancy indicators (e.g., true vs. false), and, in Step 1212, determine whether to operate the ceiling fan. The analysis and determination of Steps 1210-1212 can be performed in a similar manner as discussed above at least in relation to Steps 1112-1114 of Process 1100.

As such, in Step 1212, engine 200 can determine whether to operate the ceiling fan for the "winter" algorithm 700, as discussed above. In some embodiments, the operation of the ceiling fan for the "winter" algorithm 700 can be based on the temperature at the ceiling in relation to the temperature setpoint, as discussed above and illustrated in FIG. 12.

Thus, in some embodiments, when it is determined to operate the ceiling fan in Step 1212, engine 200 can proceed to Step 1216, which enables the execution of a heating operation mode for the ceiling fan, as discussed herein. According to some embodiments, during the heating mode operation, and/or upon its conclusion, engine 200 can proceed to Step 1218, where engine 200 recursively reverts back to Step 1202 for continued monitoring of the location.

In some embodiments, when it is determined that the ceiling fan is not the be operated, processing proceeds to Step 1214, where the monitoring of the temperature at the ceiling fan is continued, where the ceiling fan's operation is bypassed (e.g., it is not operated, and engine 200 recursively reverts back to Step 1202 for continued monitoring of the location).

Additionally, or in the alternative, according to some embodiments, such determination of Step 1212 may be based on occupancy in the location. For example, in some embodiments, when engine 200 determines that there are no occupants in the location associated with the ceiling fan (and/or that the temperature of the ceiling fan is within range of the temperate setpoint), then engine 200 can proceed from Step 1212 to Step 1214, as discussed above.

Accordingly, in some embodiments, when engine 200 determines that there is at least one occupant in the location associated with the ceiling fan (and/or that the temperature of the ceiling fan is outside a range of the temperate setpoint), then engine 200 can proceed from Step 1212 to Step 12162, as discussed above.

Figure 15:
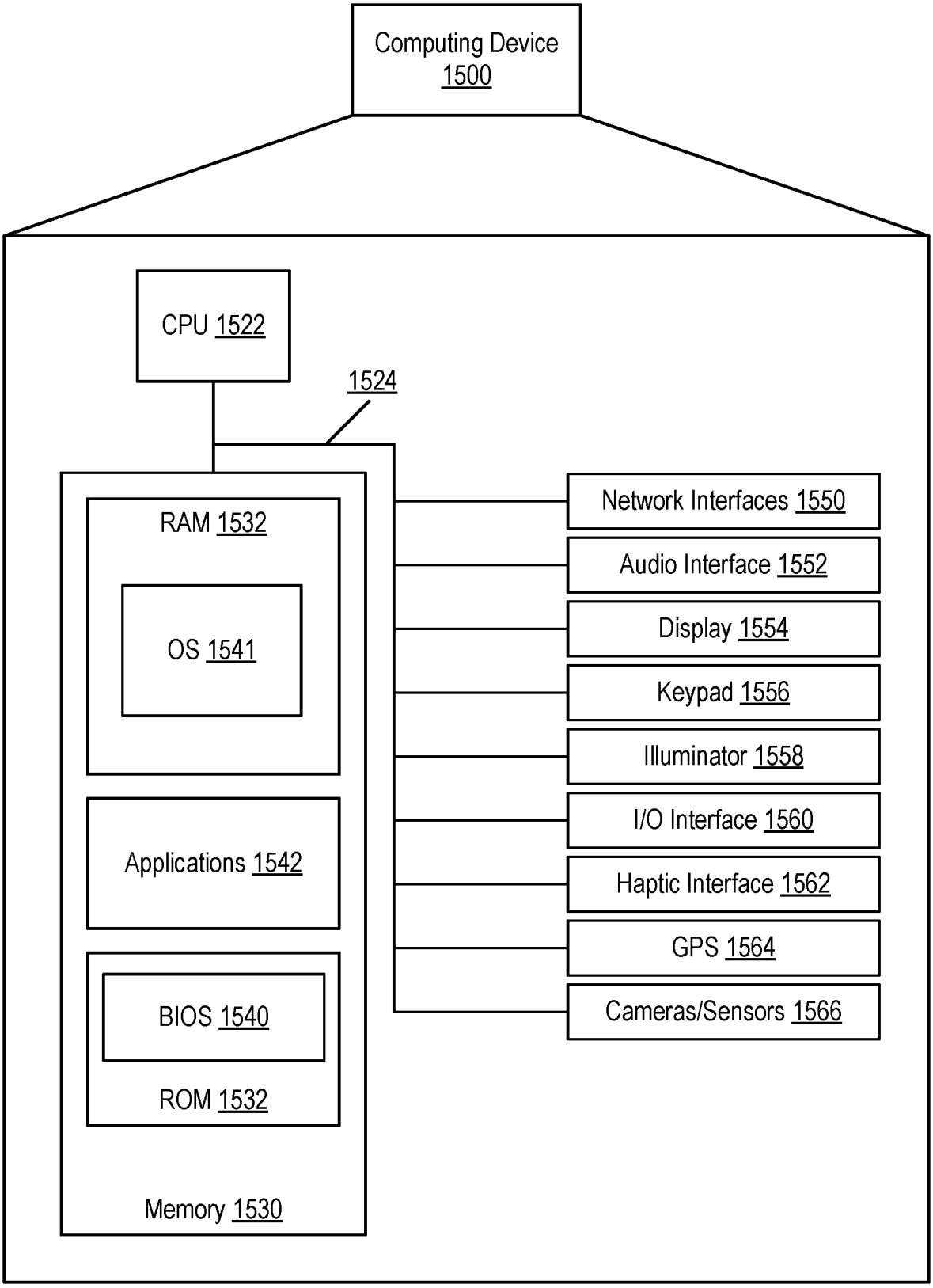
FIG. 15 is a block diagram illustrating a computing device showing an example of a client or server device used in various embodiments of the present disclosure.

FIG. 15 is a schematic diagram illustrating a client device showing an example embodiment of a client device that may be used within the present disclosure. Client device 1500 may include many more or less components than those shown in FIG. 15. However, the components shown are sufficient to disclose an illustrative embodiment for implementing the present disclosure. Client device 1500 may represent, for example, UE 112 discussed above at least in relation to FIG. 1.

As shown in the figure, in some embodiments, Client device 1500 includes a processing unit (CPU) 1522 in communication with a mass memory 1530 via a bus 1524. Client device 1500 also includes a power supply 1526, one or more network interfaces 1550, an audio interface 1552, a display 1554, a keypad 1556, an illuminator 1558, an input/output interface 1560, a haptic interface 1562, an optional global positioning systems (GPS) receiver 1564 and a camera(s) or other optical, thermal or electromagnetic sensors 1566. Device 1500 can include one camera/sensor 1566, or a plurality of cameras/sensors 1566, as understood by those of skill in the art. Power supply 1526 provides power to Client device 1500.

Client device 1500 may optionally communicate with a base station (not shown), or directly with another computing device. In some embodiments, network interface 1550 is sometimes known as a transceiver, transceiving device, or network interface card (NIC).

Audio interface 1552 is arranged to produce and receive audio signals such as the sound of a human voice in some embodiments. Display 1554 may be a liquid crystal display (LCD), gas plasma, light emitting diode (LED), or any other type of display used with a computing device. Display 1554 may also include a touch sensitive screen arranged to receive input from an object such as a stylus or a digit from a human hand.

Keypad 1556 may include any input device arranged to receive input from a user. Illuminator 1558 may provide a status indication and/or provide light.

Client device 1500 also includes input/output interface 1560 for communicating with external. Input/output interface 1560 can utilize one or more communication technologies, such as USB, infrared, Bluetooth™, or the like in some embodiments. Haptic interface 1562 is arranged to provide tactile feedback to a user of the client device.

Optional GPS transceiver 1564 can determine the physical coordinates of Client device 1500 on the surface of the Earth, which typically outputs a location as latitude and longitude values. GPS transceiver 1564 can also employ other geo-positioning mechanisms, including, but not limited to, triangulation, assisted GPS (AGPS), E-OTD, CI, SAI, ETA, BSS or the like, to further determine the physical location of client device 1500 on the surface of the Earth. In one embodiment, however, Client device may through other components, provide other information that may be employed to determine a physical location of the device, including for example, a MAC address, Internet Protocol (IP) address, or the like.

Mass memory 1530 includes a RAM 1532, a ROM 1534, and other storage means. Mass memory 1530 illustrates another example of computer storage media for storage of information such as computer readable instructions, data structures, program modules or other data. Mass memory 1530 stores a basic input/output system ("BIOS") 1540 for controlling low-level operation of Client device 1500. The mass memory also stores an operating system 1541 for controlling the operation of Client device 1500.

Memory 1530 further includes one or more data stores, which can be utilized by Client device 1500 to store, among other things, applications 1542 and/or other information or data. For example, data stores may be employed to store information that describes various capabilities of Client device 1500. The information may then be provided to another device based on any of a variety of events, including being sent as part of a header (e.g., index file of the HLS stream) during a communication, sent upon request, or the like. At least a portion of the capability information may also be stored on a disk drive or other storage medium (not shown) within Client device 1500.

Applications 1542 may include computer executable instructions which, when executed by Client device 1500, transmit, receive, and/or otherwise process audio, video, images, and enable telecommunication with a server and/or another user of another client device. Applications 1542 may further include a client that is configured to send, to receive, and/or to otherwise process gaming, goods/services and/or other forms of data, messages and content hosted and provided by the platform associated with engine 200 and its affiliates.

As used herein, the terms "computer engine" and "engine" identify at least one software component and/or a combination of at least one software component and at least one hardware component which are designed/programmed/configured to manage/control other software and/or hardware components (such as the libraries, software development kits (SDKs), objects, and the like).

Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. In some embodiments, the one or more processors may be implemented as a Complex Instruction Set Computer (CISC) or Reduced Instruction Set Computer (RISC) processors; x86 instruction set compatible processors, multi-core, or any other microprocessor or central processing unit (CPU). In various implementations, the one or more processors may be dual-core processor(s), dual-core mobile processor(s), and so forth.

Computer-related systems, computer systems, and systems, as used herein, include any combination of hardware and software. Examples of software may include software components, programs, applications, operating system software, middleware, firmware, software modules, routines, subroutines, functions, methods, procedures, software interfaces, application program interfaces (API), instruction sets, computer code, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

For the purposes of this disclosure a module is a software, hardware, or firmware (or combinations thereof) system, process or functionality, or component thereof, that performs or facilitates the processes, features, and/or functions described herein (with or without human interaction or augmentation). A module can include sub-modules. Software components of a module may be stored on a computer readable medium for execution by a processor. Modules may be integral to one or more servers, or be loaded and executed by one or more servers. One or more modules may be grouped into an engine or an application.

One or more aspects of at least one embodiment may be implemented by representative instructions stored on a machine-readable medium which represents various logic within the processor, which when read by a machine causes the machine to fabricate logic to perform the techniques described herein. Such representations, known as "IP cores," may be stored on a tangible, machine readable medium and supplied to various customers or manufacturing facilities to load into the fabrication machines that make the logic or processor. Of note, various embodiments described herein may, of course, be implemented using any appropriate hardware and/or computing software languages (e.g., C++, Objective-C, Swift, Java, JavaScript, Python, Perl, QT, and the like).

For example, exemplary software specifically programmed in accordance with one or more principles of the present disclosure may be downloadable from a network, for example, a website, as a stand-alone product or as an add-in package for installation in an existing software application. For example, exemplary software specifically programmed in accordance with one or more principles of the present disclosure may also be available as a client-server software application, or as a web-enabled software application. For example, exemplary software specifically programmed in accordance with one or more principles of the present disclosure may also be embodied as a software package installed on a hardware device.

For the purposes of this disclosure the term "user", "subscriber" "consumer" or "customer" should be understood to refer to a user of an application or applications as described herein and/or a consumer of data supplied by a data provider. By way of example, and not limitation, the term "user" or "subscriber" can refer to a person who receives data provided by the data or service provider over the Internet in a browser session, or can refer to an automated software application which receives the data and stores or processes the data. Those skilled in the art will recognize that the methods and systems of the present disclosure may be implemented in many manners and as such are not to be limited by the foregoing exemplary embodiments and examples. In other words, functional elements being performed by single or multiple components, in various combinations of hardware and software or firmware, and individual functions, may be distributed among software applications at either the client level or server level or both. In this regard, any number of the features of the different embodiments described herein may be combined into single or multiple embodiments, and alternate embodiments having fewer than, or more than, all of the features described herein are possible.

Functionality may also be, in whole or in part, distributed among multiple components, in manners now known or to become known. Thus, myriad software/hardware/firmware combinations are possible in achieving the functions, features, interfaces and preferences described herein. Moreover, the scope of the present disclosure covers conventionally known manners for carrying out the described features and functions and interfaces, as well as those variations and modifications that may be made to the hardware or software or firmware components described herein as would be understood by those skilled in the art now and hereafter.

Furthermore, the embodiments of methods presented and described as flowcharts in this disclosure are provided by way of example in order to provide a more complete understanding of the technology. The disclosed methods are not limited to the operations and logical flow presented herein. Alternative embodiments are contemplated in which the order of the various operations is altered and in which sub-operations described as being part of a larger operation are performed independently.

While various embodiments have been described for purposes of this disclosure, such embodiments should not be deemed to limit the teaching of this disclosure to those embodiments. Various changes and modifications may be made to the elements and operations described above to obtain a result that remains within the scope of the systems and processes described in this disclosure.

What is claimed is:

1. A method comprising:

collecting, by a device, sensor data related to a location, the location comprising at least one physical area having a ceiling fan positioned therein;

analyzing, by the device, the sensor data;

determining, by the device, based on analysis of the sensor data, a temperature associated with the ceiling fan and a temperature setpoint;

further analyzing, by the device, the sensor data, and determining, based on the further analysis, occupancy information related to the location, the occupancy information indicating a current indication of whether living occupants are physically positioned in the area having the ceiling fan;

analyzing, by the device, the ceiling fan temperature, the temperature setpoint and the occupancy information; and determining, by the device, an operation mode for the ceiling fan based on the analysis of the ceiling fan temperature, the temperature setpoint and the occupancy information; and automatically controlling, by the device, the ceiling fan based on the determined operation mode.

2. The method of claim 1, further comprising:

comparing the ceiling fan temperature to the temperature setpoint;

determining at temperature differential; and determining whether to operate the ceiling fan based on the temperature differential.

3. The method of claim 2, wherein the ceiling fan is operated when the temperature differential is outside of a predetermined range of temperatures.

4. The method of claim 1, further comprising:

determining the operation mode as a summer mode, the summer mode enabling the ceiling fan to spin such that associated blades of the ceiling fan propel air downwards, wherein the determination of the summer mode corresponds to the ceiling fan temperature being greater than the temperature setpoint.

5. The method of claim 1, further comprising:

determining the operation mode as a winter mode, the winter mode enabling the ceiling fan to spin such that associated blades of the ceiling fan pull air upward, wherein the determination of the winter mode corresponds to the ceiling fan temperature being less than the temperature setpoint.

6. The method of claim 1, wherein when the occupancy information indicates that there is at least one occupant within the location, the device enables the execution of the operation mode.

7. The method of claim 1, wherein when the occupancy information indicates that there are no occupants within the location, the device executes a bypass operation of the operation mode.

8. The method of claim 1, wherein the temperature associated with the ceiling fan is based on the sensor data collected from a sensor associated with a ceiling of the area.

9. The method of claim 1, wherein the ceiling sensor is physically positioned within a predetermined threshold to the ceiling fan.

10. The method of claim 1, wherein the temperature setpoint corresponds to a temperature associated with a thermostat at the location.

11. A device comprising:

at least one processor configured to:

collect sensor data related to a location, the location comprising at least one physical area having a ceiling fan positioned therein;

analyze the sensor data;

determine, based on analysis of the sensor data, a temperature associated with the ceiling fan and a temperature setpoint;

further analyze, by the device, the sensor data, and determine, based on the further analysis, occupancy information related to the location, the occupancy information indicating a current indication of whether living occupants are physically positioned in the area having the ceiling fan;

analyze the ceiling fan temperature, the temperature setpoint and the occupancy information; and determine an operation mode for the ceiling fan based on the analysis of the ceiling fan temperature, the temperature setpoint and the occupancy information; and automatically control the ceiling fan based on the determined operation mode.

12. The device of claim 11, wherein the processor is further configured to:

compare the ceiling fan temperature to the temperature setpoint;

determine at temperature differential; and determine whether to operate the ceiling fan based on the temperature differential, wherein the ceiling fan is operated when the temperature differential is outside of a predetermined range of temperatures.

13. The device of claim 11, wherein the processor is further configured to:

determine the operation mode as a summer mode, the summer mode enabling the ceiling fan to spin such that associated blades of the ceiling fan propel air downwards, wherein the determination of the summer mode corresponds to the ceiling fan temperature being greater than the temperature setpoint.

14. The device of claim 11, wherein the processor is further configured to:

determine the operation mode as a winter mode, the winter mode enabling the ceiling fan to spin such that associated blades of the ceiling fan pull air upward, wherein the determination of the winter mode corresponds to the ceiling fan temperature being less than the temperature setpoint.

15. The device of claim 11, wherein when the occupancy information indicates that there is at least one occupant within the location, the device enables the execution of the operation mode, wherein when the occupancy information indicates that there are no occupants within the location, the device executes a bypass operation of the operation mode.

16. A non-transitory computer-readable storage medium tangibly encoded with computer-executable instructions that when executed by a device, perform a method comprising:

collecting, by the device, sensor data related to a location, the location comprising at least one physical area having a ceiling fan positioned therein;

analyzing, by the device, the sensor data;

determining, by the device, based on analysis of the sensor data, a temperature associated with the ceiling fan and a temperature setpoint;

further analyzing, by the device, the sensor data, and determining, based on the further analysis, occupancy information related to the location, the occupancy information indicating a current indication of whether living occupants are physically positioned in the area having the ceiling fan;

analyzing, by the device, the ceiling fan temperature, the temperature setpoint and the occupancy information; and determining, by the device, an operation mode for the ceiling fan based on the analysis of the ceiling fan temperature, the temperature setpoint and the occupancy information; and automatically controlling, by the device, the ceiling fan based on the determined operation mode.

17. The non-transitory computer-readable storage medium of claim 16, further comprising:

comparing the ceiling fan temperature to the temperature setpoint;

determining at temperature differential; and determining whether to operate the ceiling fan based on the temperature differential, wherein the ceiling fan is operated when the temperature differential is outside of a predetermined range of temperatures.

18. The non-transitory computer-readable storage medium of claim 16, further comprising:

determining the operation mode as a summer mode, the summer mode enabling the ceiling fan to spin such that associated blades of the ceiling fan propel air downwards, wherein the determination of the summer mode corresponds to the ceiling fan temperature being greater than the temperature setpoint.

19. The non-transitory computer-readable storage medium of claim 16, further comprising:

determining the operation mode as a winter mode, the winter mode enabling the ceiling fan to spin such that associated blades of the ceiling fan pull air upward, wherein the determination of the winter mode corresponds to the ceiling fan temperature being less than the temperature setpoint.

20. The non-transitory computer-readable storage medium of claim 16, wherein when the occupancy information indicates that there is at least one occupant within the location, the device enables the execution of the operation mode, wherein when the occupancy information indicates that there are no occupants within the location, the device executes a bypass operation of the operation mode.

* * * * *